United States Patent [19]

Elford

[11] Patent Number: 4,892,062

[45] Date of Patent: Jan. 9, 1990

[54] SHEEP HANDLING AND MANIPULATION FOR AUTOMATED SHEARING

[75] Inventor: David Elford, Mount Hawthron, Australia

[73] Assignee: The University of Western Australia, Nedlands, Australia

[21] Appl. No.: 242,757

[22] Filed: Sep. 9, 1988

[30] Foreign Application Priority Data

Sep. 9, 1987 [AU] Australia ..... PI4317
Jul. 15, 1988 [AU] Australia ..... PI9319

[51] Int. Cl.[4] ..... A61D 3/00
[52] U.S. Cl. ..... 119/98
[58] Field of Search ..... 119/93, 99; 17/24

[56] References Cited

U.S. PATENT DOCUMENTS 3,023,734 3/1962 Schaub ..... 119/99
3,215,120 11/1965 Geary ..... 119/98
4,223,639 9/1980 Korkowski ..... 119/98
4,312,300 1/1982 Hopkins ..... 119/98
4,782,791 11/1988 Brock ..... 119/98

*Primary Examiner*—Paul J. Hirsch
*Attorney, Agent, or Firm*—Cushman, Darby & Cushman

[57] ABSTRACT

A system for handling sheep during automated shearing comprising a multiplicity of trolley/cradles T including rollers 16 and 17 for supporting the sheep, and front leg clamping bars 11 and 12, a head clamping bar 13 and rear clamping bars 20 and 21, each of which is releasably mounted on the trolley in a manner which enables selective release thereof whereby the front legs and head and the rear legs of the sheep and independently manipulatable by manipulating means 31, 40 and 41 located at a shearing station, and means FIG. 1 for transporting each trolley T from a loading station to a shearing station and from the shearing station to an unloading station whereby the sheep may be shorn in an automated manner.

10 Claims, 24 Drawing Sheets

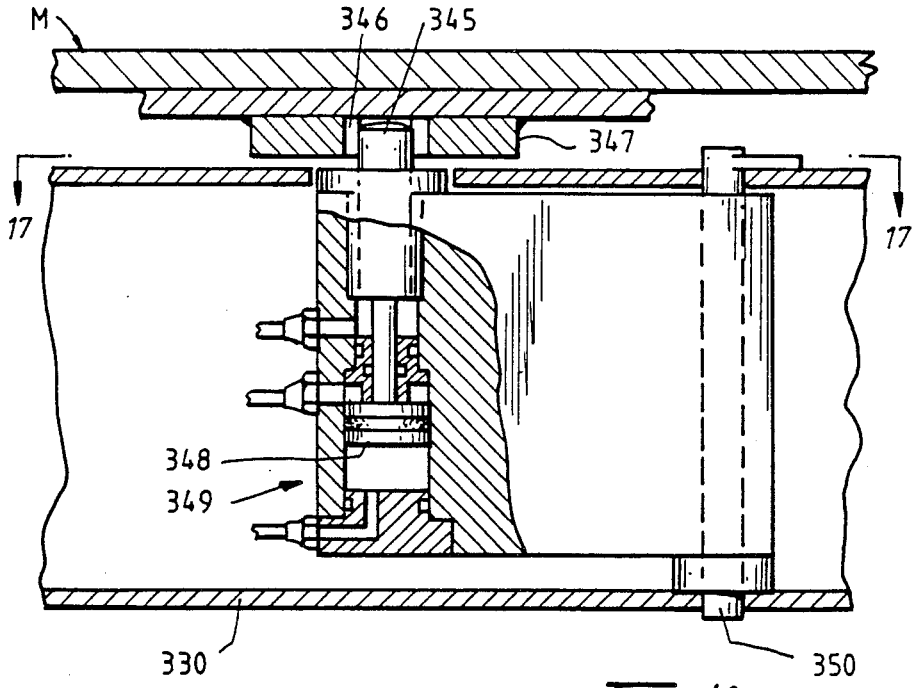
FIG. 16.
FIG. 17.
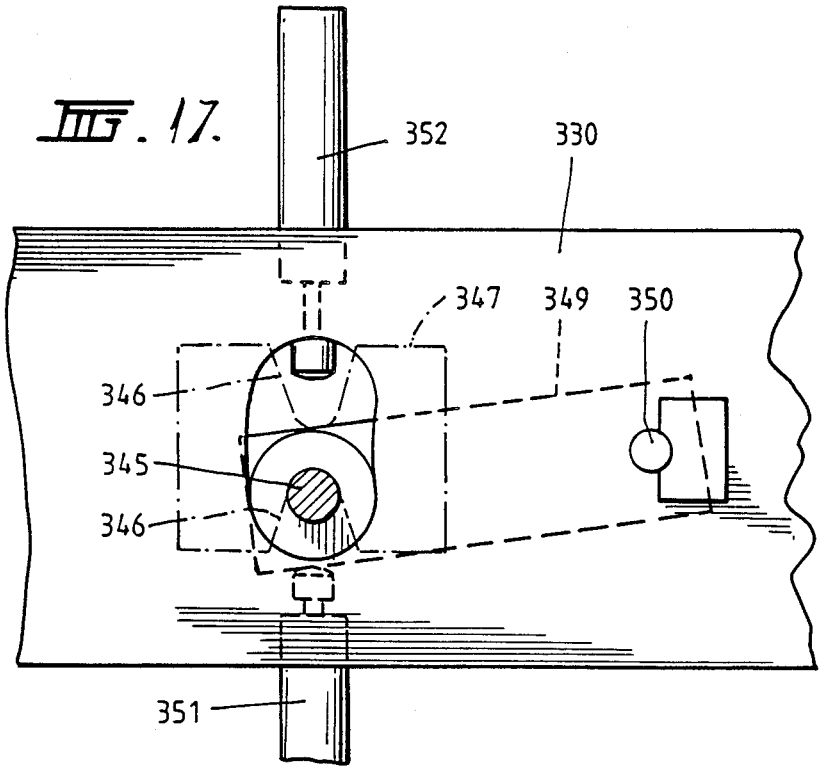

SHEEP HANDLING AND MANIPULATION FOR AUTOMATED SHEARING

FIELD OF THE INVENTION:

This invention relates to systems for the handling, restraint and manipulation of animals such as sheep and goats, particularly for the performance of automated shearing.

BACKGROUND OF THE INVENTION:

In our Australian Patent Application No. AU-A33725/84 we have described a system for the restraint and manipulation of sheep during an automated shearing process. Further research has shown that the apparatus described in this patent application has a number of shortcomings for continued use in an automated shearing environment and it has been concluded that the apparatus could not be readily adapted or modified to meet at least the more important performance features, including:

(i) Independence to sheep size.

(ii) Ease and reliability in loading and unloading sheep.

(iii) Minimum changeover time to unload and reload a sheep.

(iv) Minimum manipulation between productive shearing.

(v) Suitability for access for wool removal.

(vi) Access for shearing free of restraints etc.

(vii) Access for long productive shearing blows.

(viii) Degree of surface conditioning possible.

(ix) Suitability for segregating the belly wool and crutchings.

(x) Wool flow—lack of interference of shorn wool with the shearing task (both severance, sensing and vision).

(xi) Suitability for one piece fleece removal.

(xii) Suitability for in line fleece conveying from the cradle.

(xiii) Simplicity of the cradle.

(xiv) Protection of mechanisms from contaminants.

(xv) Suitability for simultaneous shearing and manipulation.

(xvi) Clarity of exposure for vision sensing.

(xvii) Safety for animal at all times, including ease of emergency release.

While not all of the above features are of significant importance, each of the features require some consideration and any device which meets of the criteria set out above would be regarded as being worthy of further investigation.

Our further research on the apparatus described in the foregoing patent application indicated the following shortcomings:

(i) It does not provide adequate access free from restraint mechanisms to permit productive shearing.

(ii) It requires excessive manipulation without any possibility of concurrent shearing.

(iii) It will be difficult, and possibly unreliable, to automatically load and unload.

(iv) It will take excessive time to load and unload.

(v) It would be impossible to effectively provide for safe and productive human intervention.

(vi) Each unit would likely need its own sheep feed system.

(vii) Wool removal would be most difficult and impossible to execute in one piece.

(viii) The cradle would not be simple or easy to protect from contaminants.

(ix) As noted above it would have a limited sheep size range capability.

(x) The intervention of restraint mechanisms would degrade any vision sensing capabilities desired.

On the basis of the above, it was concluded that further development or modification of the apparatus described in the foregoing patent application was not warranted.

A large number of sheep restraining cradles have been proposed over the years but most of these offer only rudimentary restraint and little or not capacity for manipulation. One recently developed cradle which does offer some advantageous features, particularly ease of loading and unloading, is described in Australian Patent No. 550883. However, this cradle still has several disadvantages, the most notable being the location of the drive mechanism for rotating rollers at each end of the rollers, the positioning of the means for pivoting the cradle assembly, the need for manual intervention in the loading, elevation and unloading of the cradle, and the inability to swivel and tilt the cradle while the animal is at least partly restrained.

In addition to the above, the need to pivot the cradle assembly, while offering a boon to the farmer-shearer by significantly reducing in the effort required in loading and unloading the sheep, complicates the cradle construction and operation and seriously compromises the mechanics of any associated restraining and manipulating devices required for the automated shearing process.

A further problem associated with any attempt to automate the shearing process is involved in the transportation of the sheep from a catching station to the restraining and manipulating means which must form part of any automated shearing system. In order to achieve the full benefits of automation, the sheep must be transported from the catching station to the manipulating and shearing station in a manner which ensures that they remain properly restrained for presentation in a predetermined and reproducible manner. Prior art attempts to automate the shearing process have involved conveyor systems by means of which the sheep are supported by their front or rear legs for presentation to one or more shearing stations. Such an arrangement does not ensure that the sheep are presented to the shearing station in an accurately reproducible manner, and this method of supporting the sheep is also inappropriate for other reasons, including discomfort of the animal.

SUMMARY OF INVENTION AND OBJECTS:

It is an object of the present invention to provide an improved system for handling, restraining and manipulating animals such as sheep which suffers from less of the above disadvantages than the prior art devices.

In a first aspect, the invention provides a system for handling animals such as sheep and goats in the automated treatment of such animals, comprising a multiplicity of animal supporting devices carrying means for supporting the animals and for restraining the front legs, rear legs and head of the animal, each said supporting device being capable of being transported from an animal loading station to a treatment or manipulation station, means at said manipulation station for engaging and manipulating said supporting and restraining means to facilitate treatment of the animal, whereupon the supporting device may be transported with the animal restrained thereon to an unloading station.

The above system offers a number of distinct advantages compared with prior art proposals for mechanised shearing systems. Since each animal is supported and restrained in the same manner on a similar supporting device, the shearing system need only apply limited adjustments to allow for the size, type and condition of the animal. Furthermore, since it has been concluded that the animal must be manually loaded and restrained any necessary judgements regarding these factors may be made by means of an experienced operator well in advance of commencement of the shearing process.

Each animal supporting device preferably comprises a pair of spaced generally parallel rollers, frame means having means for supporting said rollers for rotation about their longitudinal axes, said frame means including means by which the supporting device may be transported from said loading station to said treatment or manipulation station, said means for restraining the front legs, rear legs and head of the animal being carried by said frame means in a selectively releasable manner whereby said restraining means may be transferred to the manipulating means at said treatment or manipulation station.

The frame supporting said rollers preferably carries wheels whereby the supporting device defines a trolley, said wheels being formed to engage rails at the treatment or manipulation station whereby the trolley may be accurately positioned at said station. Transportation between the loading station and the treatment or manipulation station may be by means of rails and/or by means of a conveyor if the available space does not permit the trolley to be turned. Similar means for transporting the trolley from the treatment or manipulation station to the unloading station may also be provided.

In a presently preferred form of the invention, each supporting device includes a front support assembly and a rear support assembly adjustably carried by said frame means to allow animals of different sizes to be restrained on the device, said front support assembly including said means for restraining the front legs and head of the animal, said rear support assembly including said means for restraining the rear legs of the animal, and drive means associated with said rollers and engagable by drive means provided at said treatment or manipulation station to rotate the rollers during the shearing operation.

The manipulating means at the treatment or manipulation station preferably includes a pair of swing arms positioned in use adjacent the front support assembly and having means for selectively engaging each of the means for restraining the front legs and head of the animal whereby the front legs and head of the animal may be independently manipulated during the shearing process. The manipulating means at the treatment or manipulation station further includes means for engaging each of the rear leg restraining means and for spreading the legs, rotating the legs and for pivoting the legs about a generally vertical axis.

In another aspect, the invention provides an animal supporting and transporting cradle comprising a pair of spaced generally parallel rollers, frame means having means for supporting said rollers for rotation about their longitudinal axes, said frame means having means by which said cradle may be transported from a loading station to a treatment or manipulation station, said frame also carrying means for restraining the front legs, rear legs and head of the animal, said front leg and head restraining means being carried by a front support in a selectively releasable manner to enable said front leg and said head restraints to be engaged by manipulating means by which said front legs and head are independently manipulated, said rear leg restraining means being carried by a rear support in a selectively releasable manner whereby said rear leg restraining means may be engaged by a rear leg manipulating means.

In a preferred form of the invention, said front leg and head restraining means are selectively secured to a support which is rotatably mounted on said front support means, said front support means carrying drive means for rotating said support, and drive means associated with said rollers, both of said drive means being selectively engagable by powered drive means at said treatment or manipulation station.

BRIEF DESCRIPTION OF THE DRAWINGS:

In order that the invention may be more fully understood, a presently preferred embodiment of the invention will now be described with reference to the accompanying drawings in which:

FIG. 16 is a fragmentary sectional elevation of the locking mechanism for the rear leg manipulating mechanism of FIG. 13 taken along the lines 16—16 in FIG. 13;

FIG. 17 is a plan view taken along the line 17—17 in FIG. 16;

Figure 1:
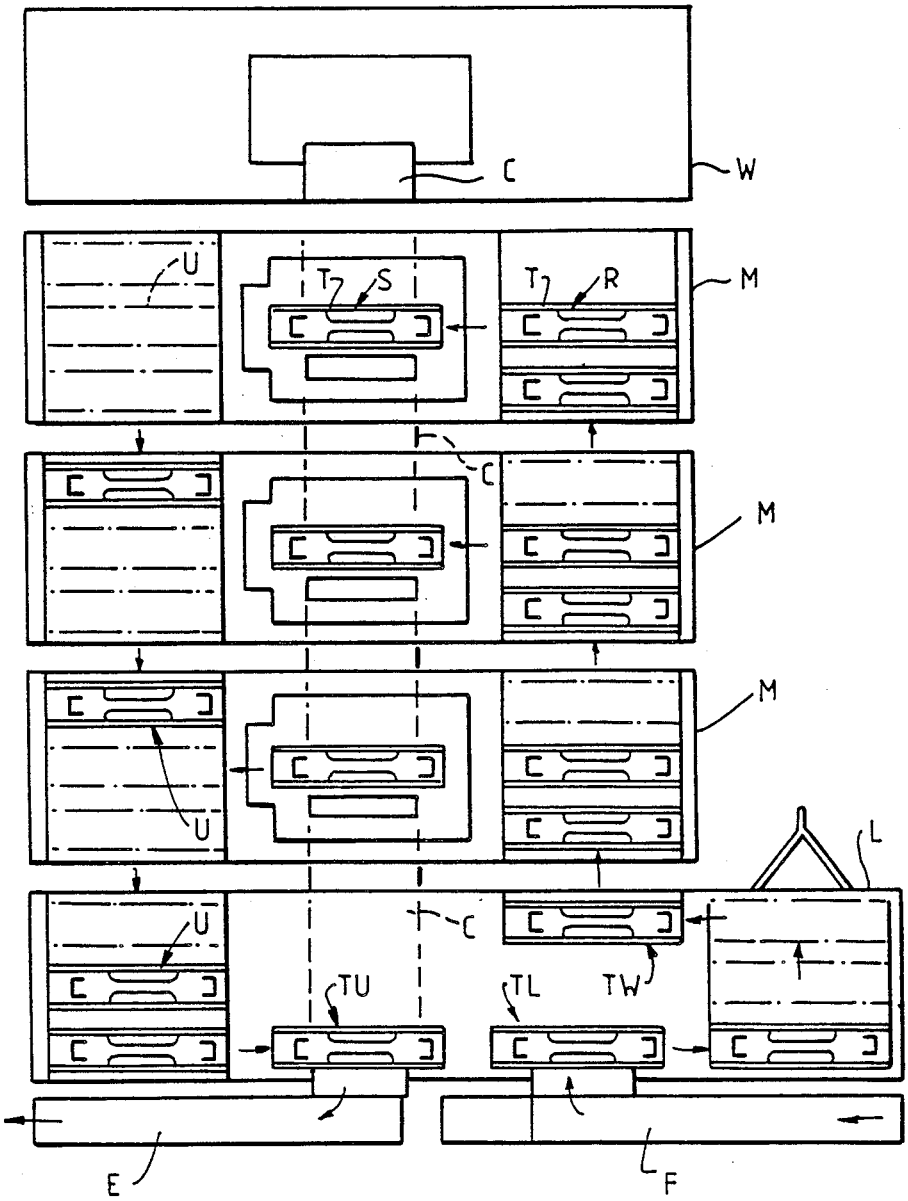
FIG. 1 is a schematic diagram of a sheep shearing system embodying the invention.
Figure 4:
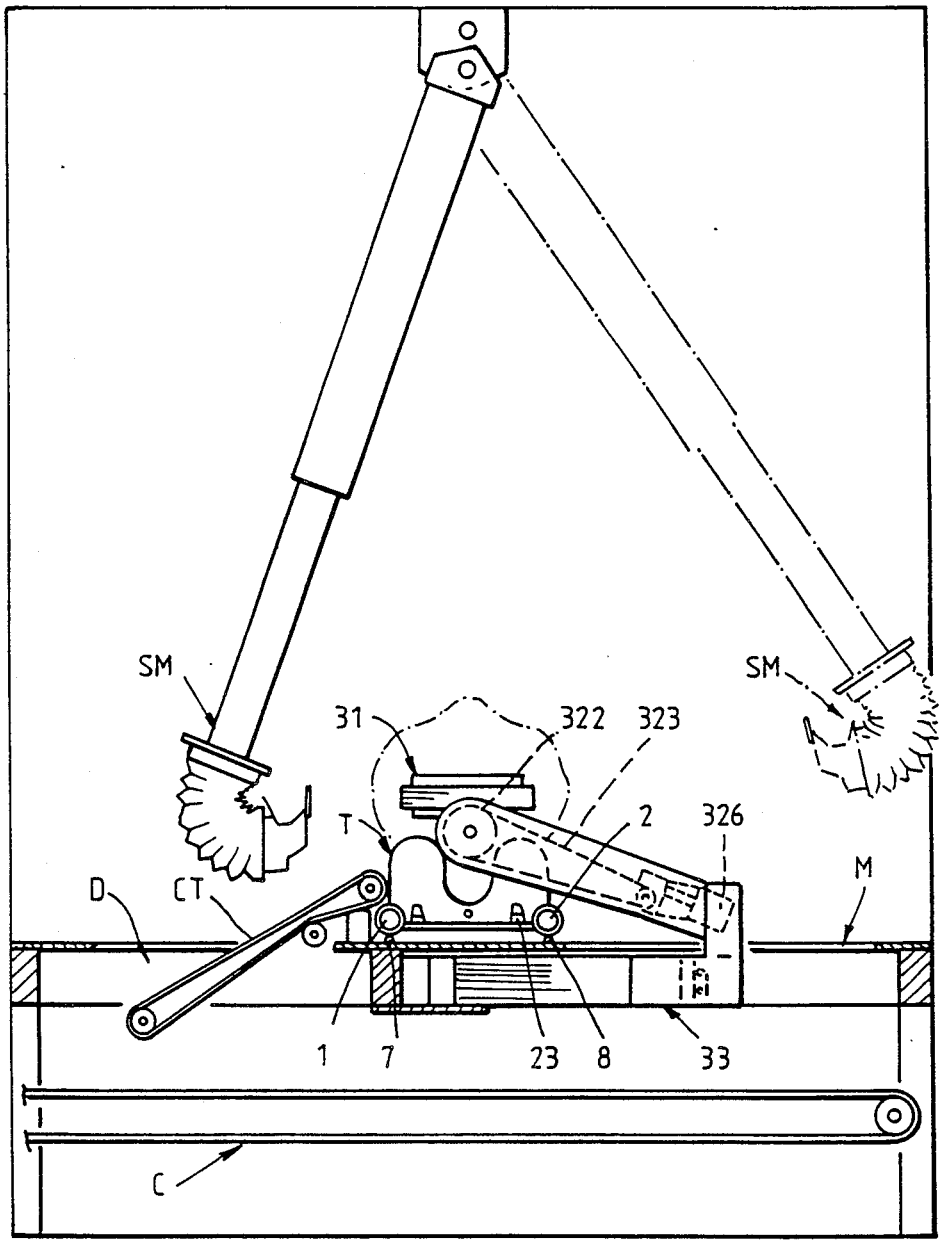
FIG. 4 is an end elevation of the shearing station of FIGS. 2 and 3.

DESCRIPTION OF THE PREFERRED EMBODIMENT:

Referring firstly to FIGS. 1 and 4 of the drawings, the sheep shearing system embodying the invention is shown to comprise a wool handling module W, a multiplicity of shearing modules M and a sheep loading and unloading module L. For clarity, the modules W, M and L have been shown slightly apart, but in practice, the modules would be mechanically locked together at the shearing site. The modules W, M and L may be in the form of wheeled trailers which are transported from one shearing site to the other by means of prime movers (not shown).

Each shearing module includes a shearing station S adapted to receive a sheep supported on a wheeled trolley T, as well as a multiplicity of reserve stations R adapted to receive sheep to be shorn on trolleys T, as well as a multiplicity of unloading stations U, adapted to receive trolleys T supporting sheep which have been shorn at the shearing station S. Each reserve station R and unloading station U forms part of an indexible conveyor system, the details of which are not shown in the drawings, but which takes any suitable form which achieves indexing of each trolley T supported by the conveyor by a predetermined amount which causes alignment between the trolleys T and transverse tracks for moving the trolleys T from a reserve station R to a shearing station S and then to an unloading station U. These tracks are not shown in FIG. 1 of the drawings but may be seen in FIGS. 2, 3 and 4 of the drawings.

A feeding race F leads to an opening in the loading and unloading module L so that sheep may be presented for loading onto the trolley $T_L$ supported on tracks (not shown) which extend to the right in FIG. 1 to allow the trolley $T_L$ to be transferred to the position shown and to be indexed upwardly from there by an indexing conveyor for transfer to the waiting position $T_W$ and for indexing by means of the conveyor system to one of the reserve positions R in one of the modules M. From there a trolley T is taken from the central position and is moved on the tracks to the shearing position S where the sheep is shorn by the computer controlled shearing robot SM, as shown in FIGS. 3 and 4 of the drawings.

When the shearing operation has been completed, the trolley T is transferred on its tracks to the central unloading position U of each module M and is then transferred by the conveyor to waiting position U in the loading and unloading module L from which it is transferred to the unloading position $T_U$ where the sheep is released and allowed to travel down the exit or unloading race E. A fleece carrying conveyor C is positioned under each shearing position S to transport the shorn fleeces to the wool handling module W. As will be seen most clearly from FIG. 4 of the drawings, each module M is formed with a discharge opening D through which a fleece transferring conveyor $C_T$ extends from a position adjacent to the trolley T to a position above the conveyor C to transfer fleece from the shorn sheep to the conveyor C.

The conveyors are operated under the control of a computer which ensures that each shearing station S has an unshorn sheep ready to be loaded and an empty unloading station U into which the trolley T carrying the shorn sheep is able to be discharged. Loading and unloading operations may be performed on a batch basis and do not have to be synchronized with the operation of the shearing stations S.

Figure 2:
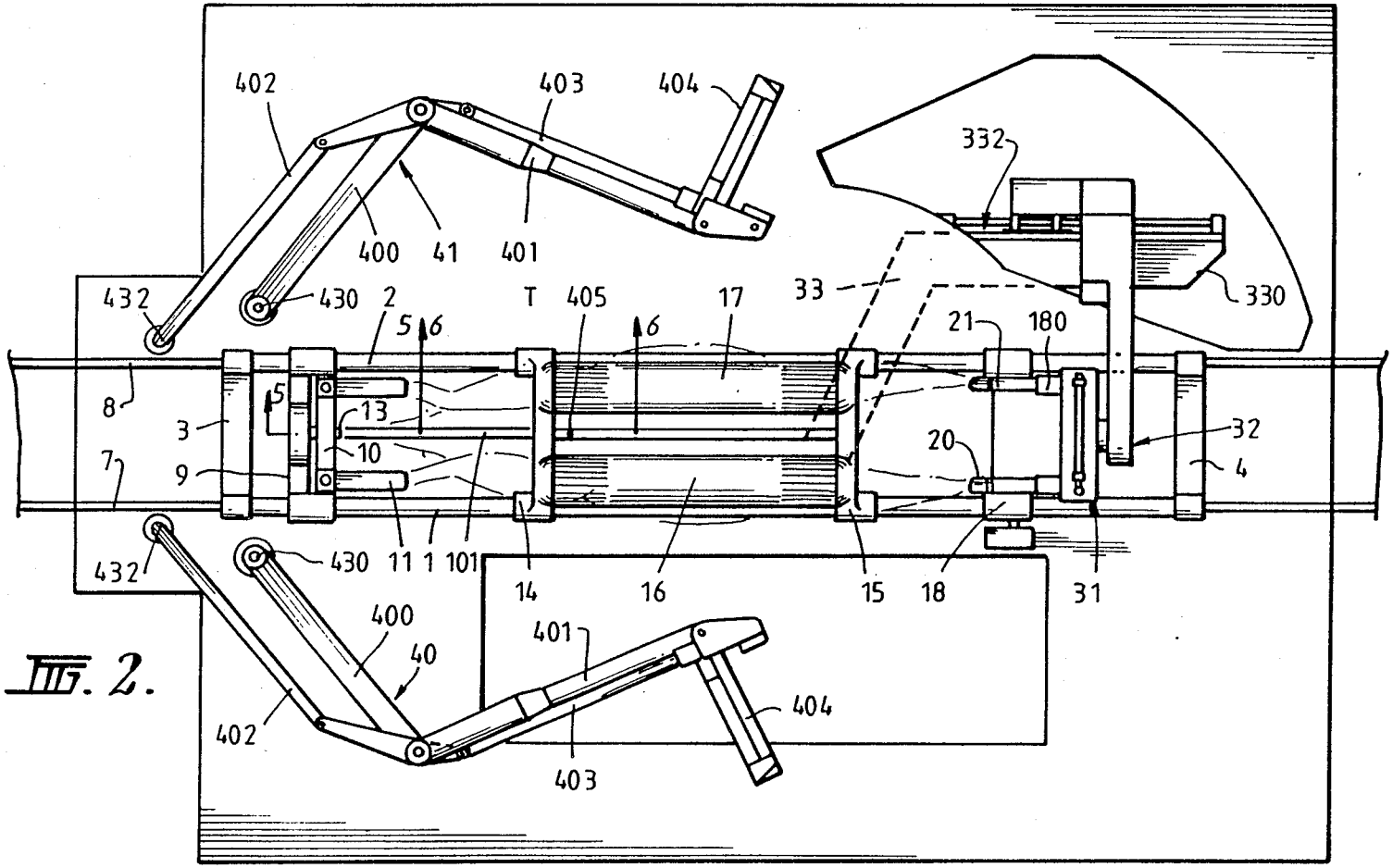
FIG. 2 is a plan view of a typical shearing station used in the shearing system of FIG. 1.
Figure 3:
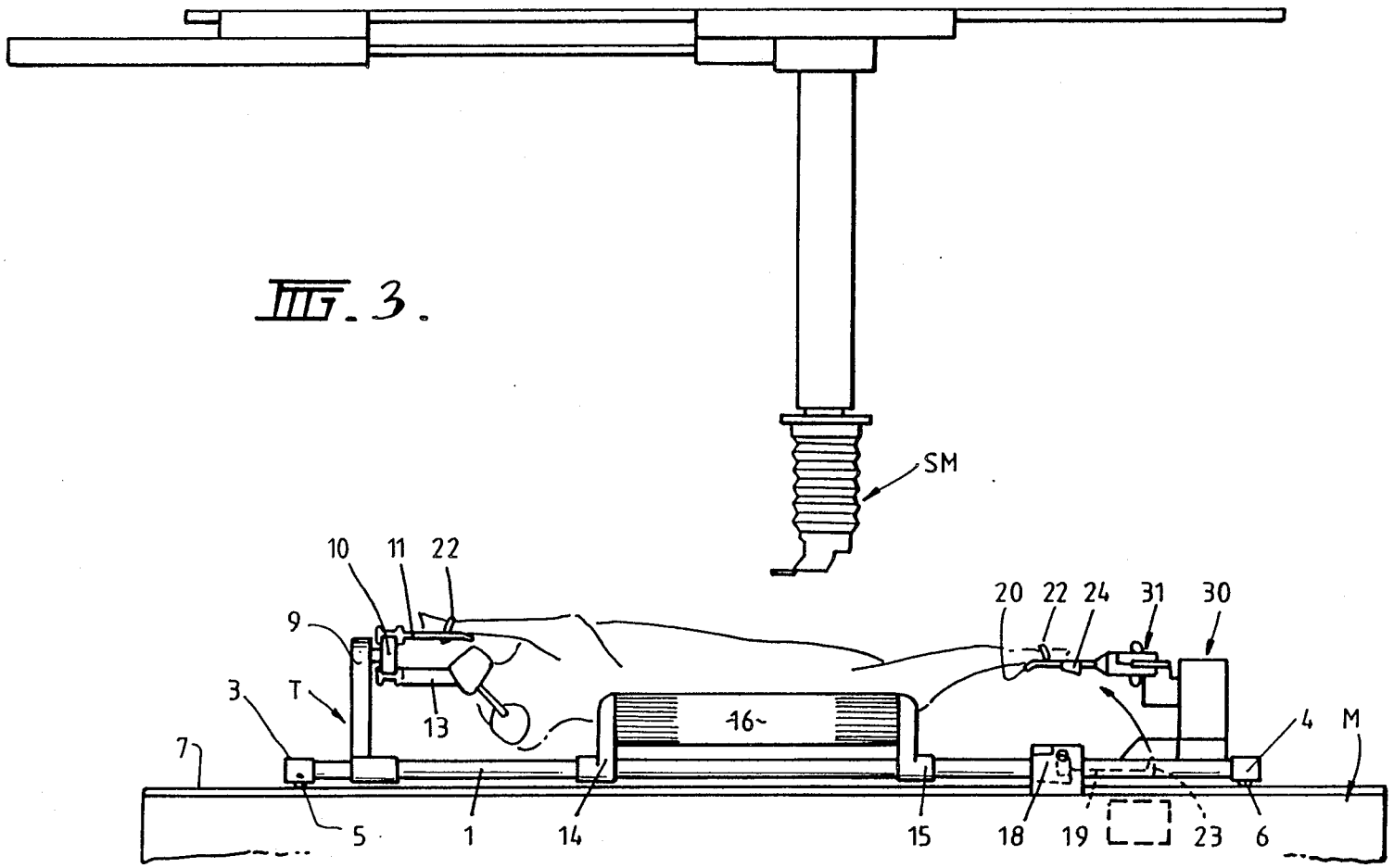
FIG. 3 is a side elevation of the shearing station of FIG. 2.

Referring now to FIGS. 2 to 4 of the drawings, each trolley T comprises two parallel tubular frame members 1 and 2 connected at either end by cross members 3 and 4 each supporting a spaced pair of ground wheels 5 and 6 which engage tracks 7 and 8 secured to the floor of the modules M and L to receive the trolleys T at the required positions from the conveyors described with reference to FIG. 1 of the drawings.

A head end support 9 which carries a head end fixture 10 which in turn carries front leg clamp bars 11 and 12 and a head clamp support 13 is slidingly supported on the frame members 1 and 2 so that its position with respect to the rest of the assembly may be adjustably secured by suitable clamping means (not shown). If desired, some form of power assistance for adjusting the position of the head end support 9 may be provided.

The frame members 1 and 2 also carry front and rear roller supports 14 and 15 which rotatably carry two parallel supporting rollers 16 and 17 which may be selectively rotated by a drive mechanism, to be described further below, carried within the front support 14.

Figure 11:
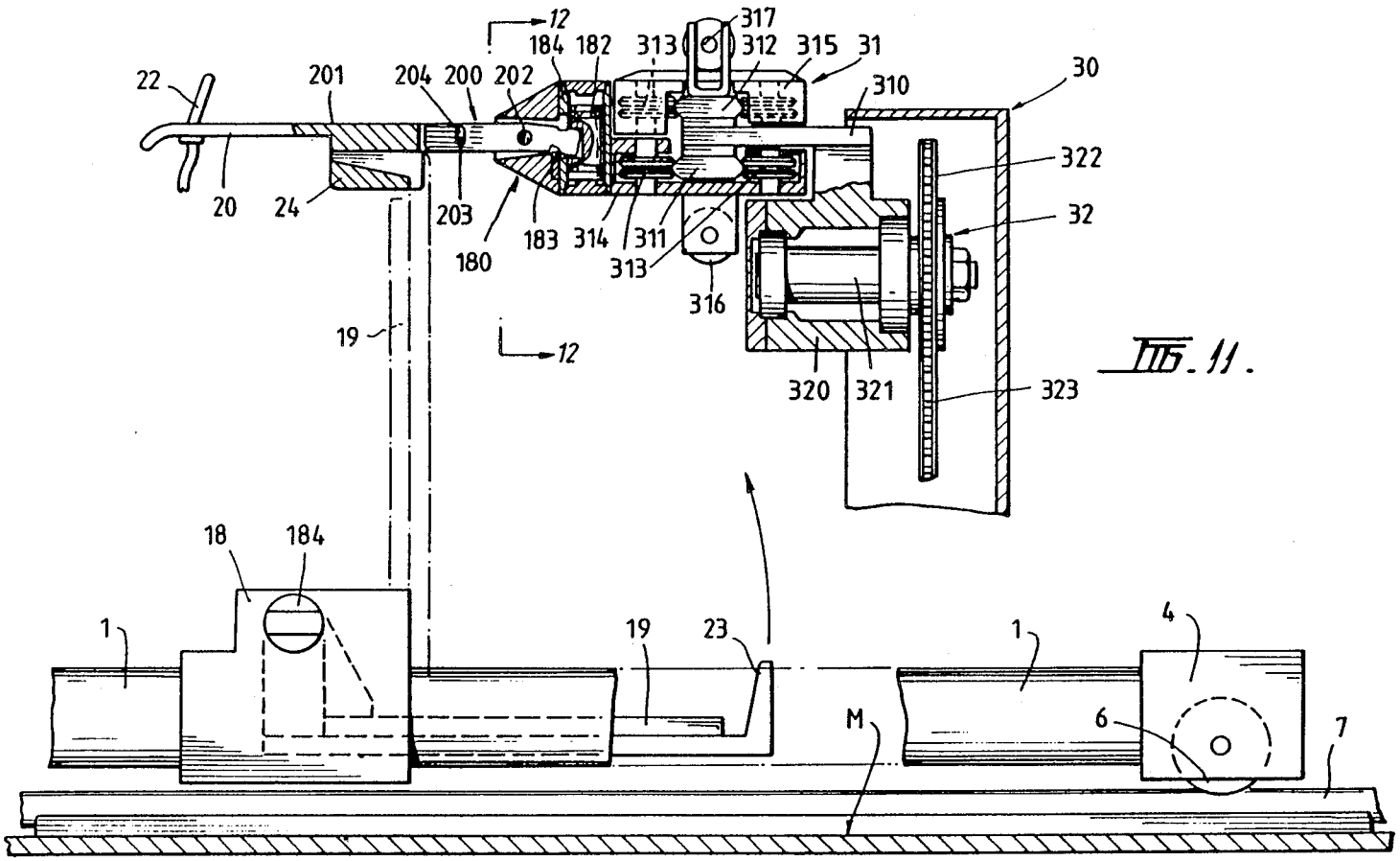
FIG. 11 is a fragmentary side elevation showing the rear end support and part of the rear leg manipulating means.

A rear end support 18 is also adjustably carried by the frame members 1 and 2 and includes an initially upstanding plate 19 pivoted to the support 18, and shown in FIGS. 3 and 11 of the drawings in its lowered position, which in turn supports a pair of rear leg clamp bars 20 and 21, to which the rear legs of the sheep are clamped by means of simple rope clamps 22. The rope clamps may take any suitable form such as a rope anchored at one end to one side of each leg clamp and passing through an opening in the other side of the leg clamp to form a loop, and a cleat (not shown) for anchoring the free end of the rope in a leg restraining position. Similar leg ties are associated with the front leg clamp bars 11 and 12 to tie the front legs of the sheep to the bars 11 and 12.

The positions of the roller supports 14 and 15 and the front end support 9 are fixed by mechanical locks at the time the trolley T is loaded with a sheep in the loading module L. Similarly, the position of the rear end support 18 is also locked at the loading station at a position which ensures that the rear legs of the sheep are stretched. When the sheep is loaded onto the trolley, the brisket of the sheep is located in a predetermined position relative to the front roller support 14, with variations in neck length and front leg length being accommodated by adjustment of the position of the front support 9. Variations in body length and rear leg length are accommodated by the adjustable positioning of the rear support 18.

Different sized rollers 16 and 17 may be fitted to the trolley T where sheep of significantly different sizes are being shorn. To this end, the rear roller support 15 is capable of being adjustably locked on the frame members 1 and 2 while the front support 14 remains in a fixed position on the frame members 1 and 2 at all times. This is necessary to allow engagement between the roller drive mechanism in the front support 14 and the power source at the shearing station S.

The outer surfaces of rollers 16 and 17 are preferably provided with regions thereof adjacent each end ribbed to improve the grip between the rollers and the sheep supported thereby. The ribbing at the rear end is more pronounced to increase the grip between the wool in the region of the stifle joint.

Figure 5:
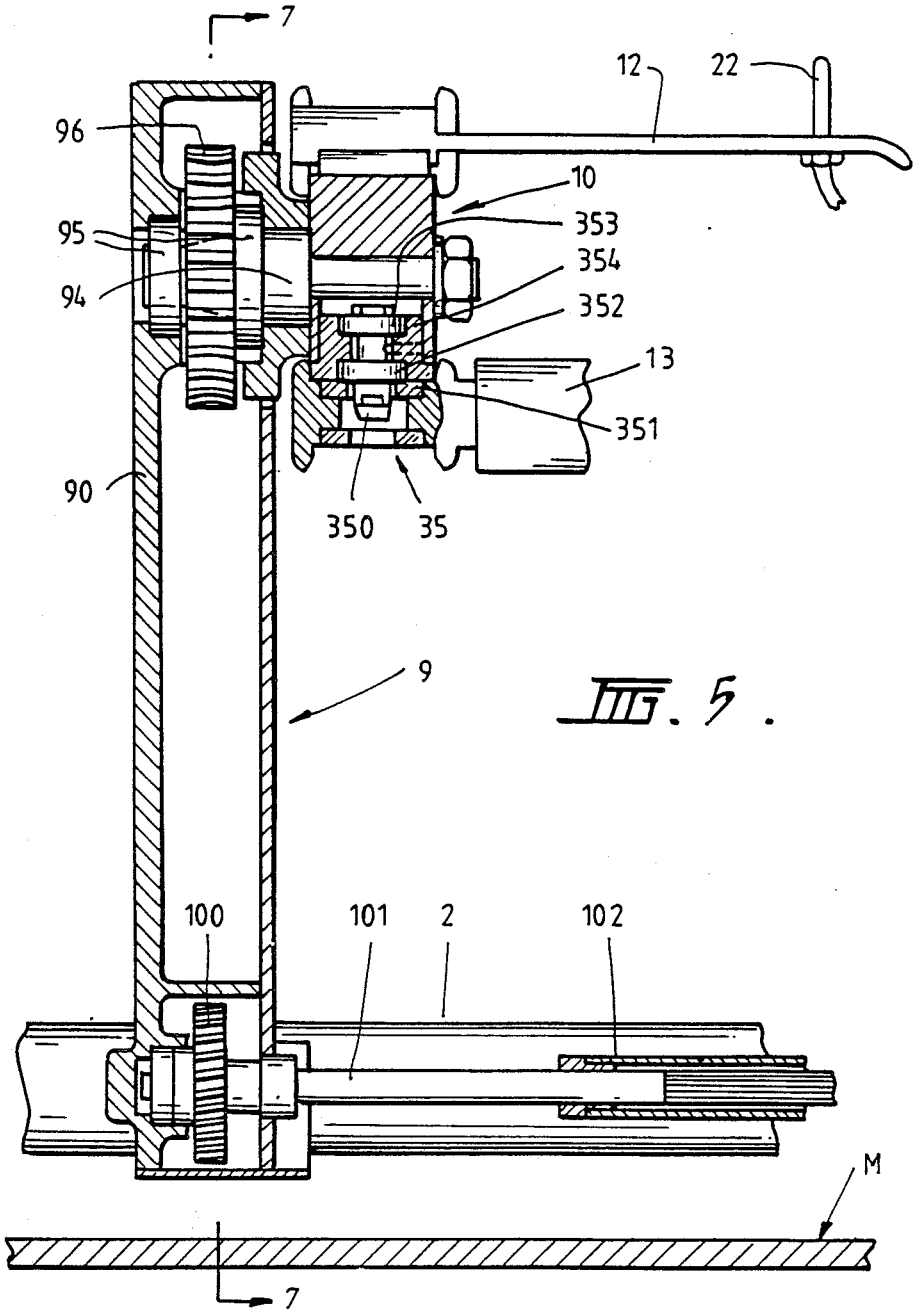
FIGS. 5 and 6 are fragmentary side elevations of part of the sheep supporting trolley and drive mechanism therefor taken along the lines 5—5 and 6—6 in FIG. 2.
Figure 6:
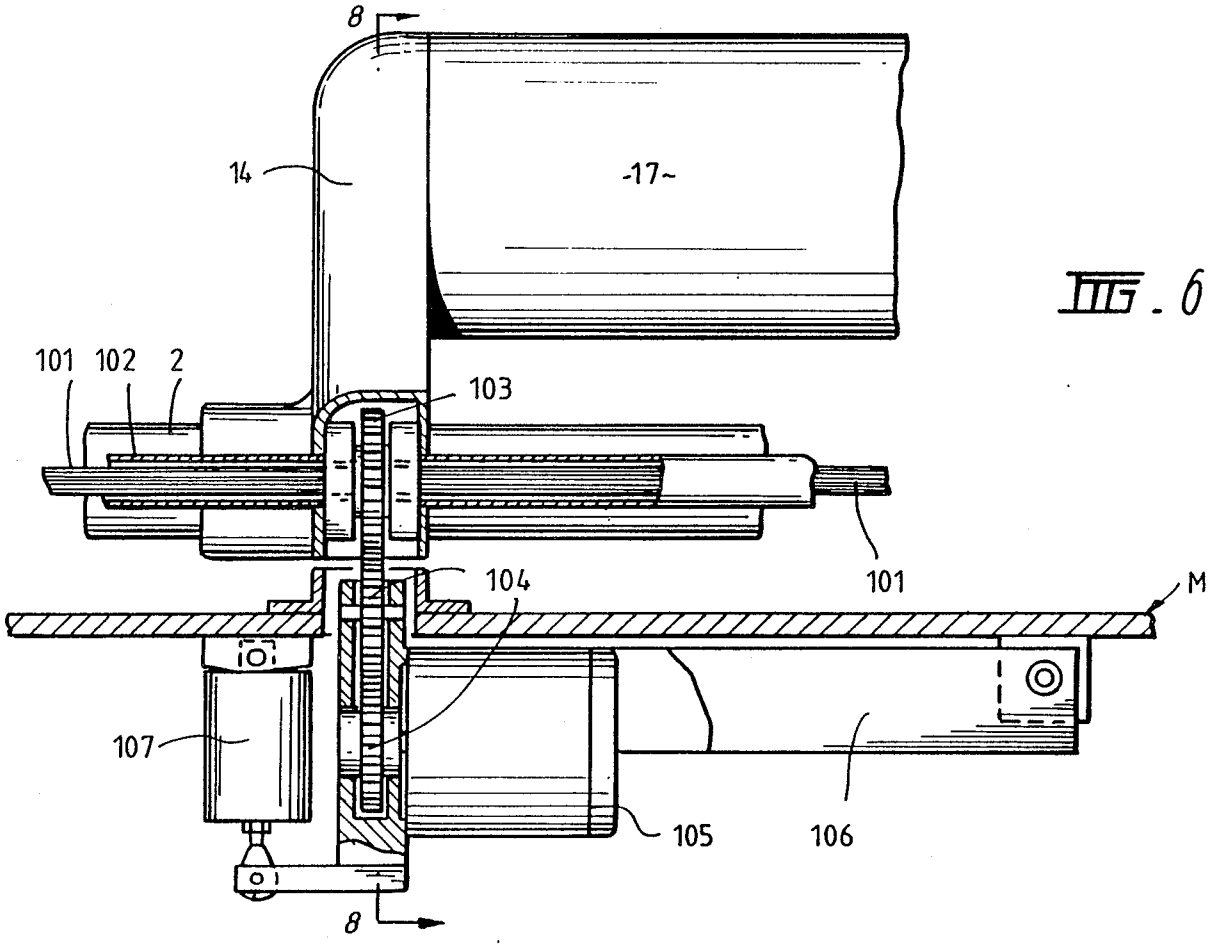
Figure 7:
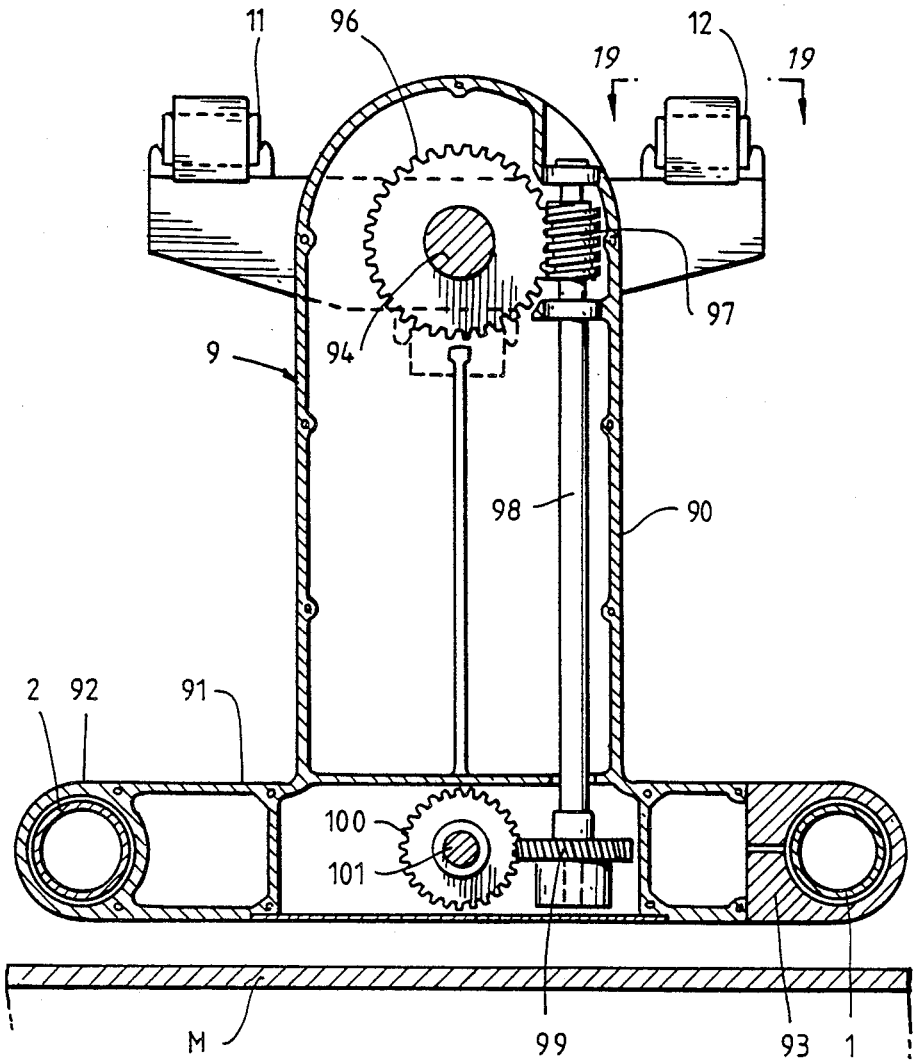
FIG. 7 is a sectional end elevation of part of the drive mechanism for achieving rotation of the front support of the trolley.

When the trolley T has been located at one of the shearing stations S, the roller drive mechanism and the front and rear leg clamp bars and the head clamp bar are selectively engaged by a source of drive and by manipulating mechanisms to enable the position of the sheep to be manipulated as dictated by the robotic shearing mechanism $S_M$ during the automated shearing process. As will be seen from FIGS. 5 to 7 of the drawings, the front end support 9 is formed as a hollow casting including a central upstanding column 90 supported by a base member 91 terminating in mounting slides 92 and 93 which receive the frame members 1 and 2 (FIG. 7). The slide 93 is split, as shown in FIG. 7, to enable clamping of the front end support 9 in any desired position by means of a clamping bolt (not shown).

The column 90 supports the head end fixture through a shaft 94 carried by bearings 95 supported by the column 90. The fixture 10 is keyed to the shaft 94 and the foreleg clamp bars 11 and 12 and the head clamp mounting bar 13 are releasably secured to the fixture 10 in a manner which will be described in greater detail below.

Figure 10:
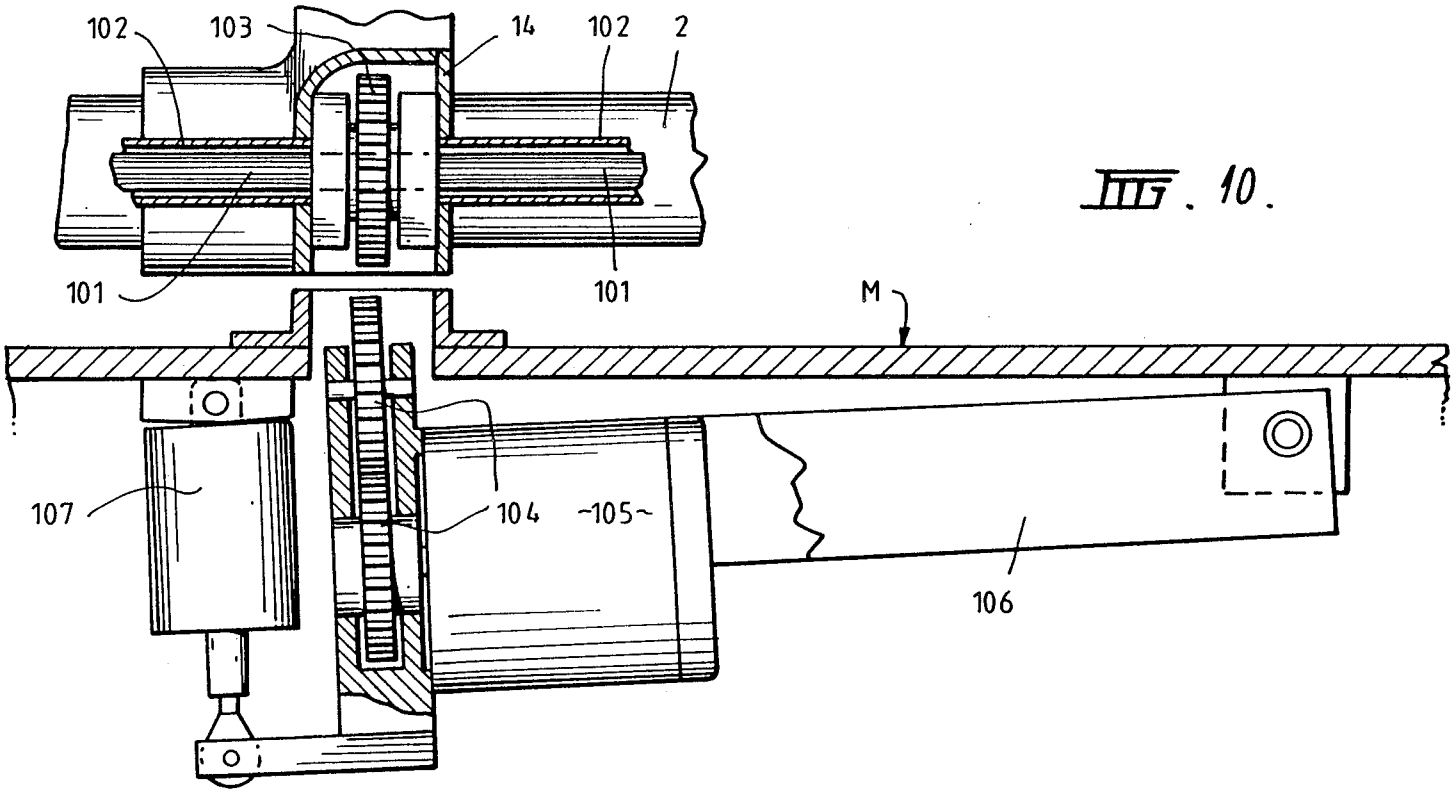
FIG. 10 is a sectional side elevation through part of the drive mechanism showing the drive to the front support disconnected.

Drive the the shaft 94 is achieved by means of a worm wheel 96 engaged by a worm 97 carried by a vertical shaft 98, which is in turn driven by a pair of crossed helical gears 99,100, the gear 100 being driven by a splined shaft 101 protected by a cover 102 and engaged by an internal splined gear 103 (FIG. 6) located within the front roller support 14 and selectively engaged by a drive train 104 driven by a stepper motor 105 carried by a pivoted beam 106 mounted under the floor of the shearing module M at the shearing station S. Selective engagement of the gear train 104 with the gear 103 is achieved by an actuator 107 via the control computer, to cause the required rotation of the fixture 10. FIG. 10 shows the drive mechanism in the disengaged position.

Figure 8:
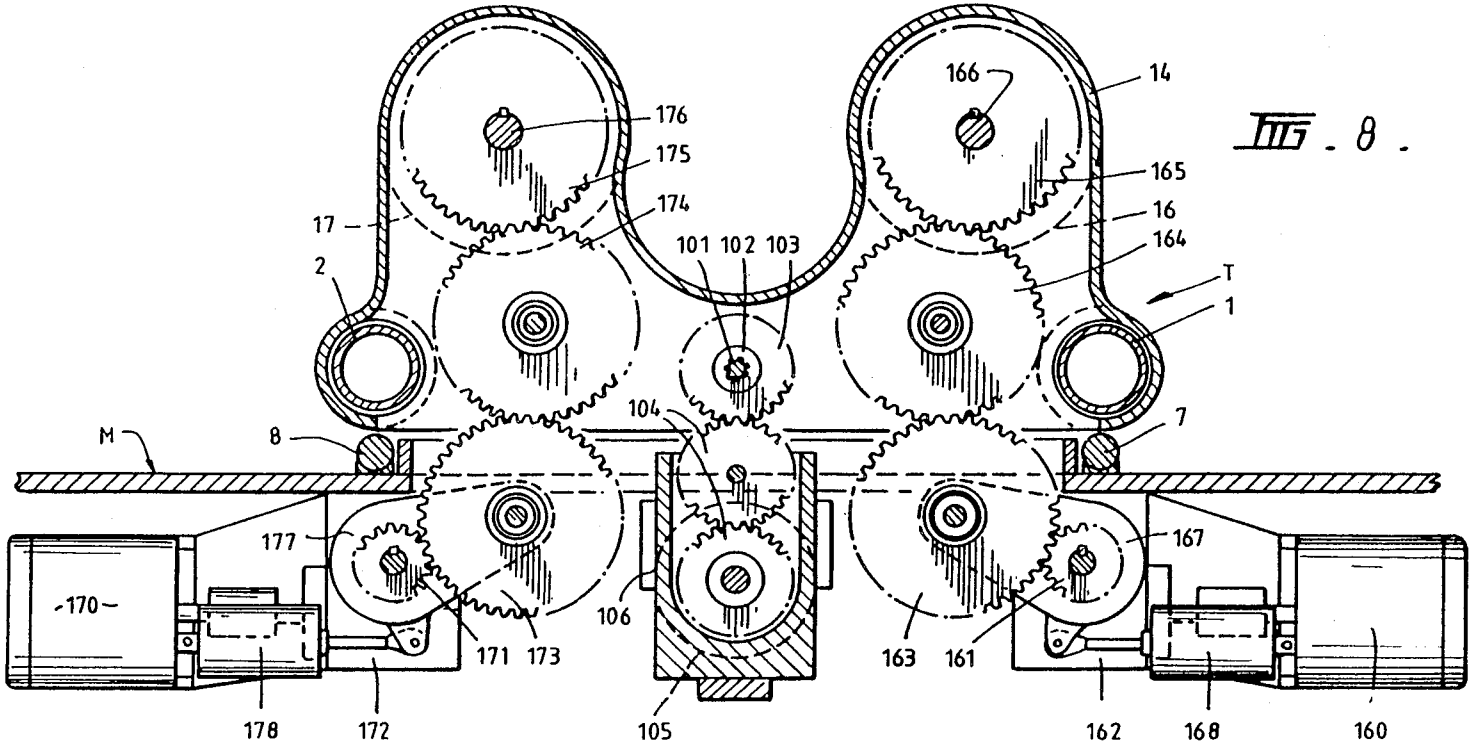
FIG. 8 is a fragmentary sectional end elevation through the trolley and the shearing station showing the drive mechanisms for the front support and for rotation of the rollers.

Drive to the rollers 16 and 17 is achieved by two independent drive trains comprising a stepper motor 160,170 driving a pinion gear 161,171 through a gear box 162,172, the pinion meshing with a spur gear 163,173, which is capable of selectively meshing with an idler gear 164,174, which in turn drives a spur gear 165,175 keyed to the shaft 166,176 of the rollers 16,17 respectively. Each spur gear 163,173 is carried by a yoke 167,177 which is pivoted about the output shaft of the gear box 162,172 so as to be rotatable from the disengaged position shown in FIG. 9 of the drawings, to the engaged position shown in FIG. 8 of the drawings by means of an actuator 168,178 by means of the central controlling computer.

Figure 9:
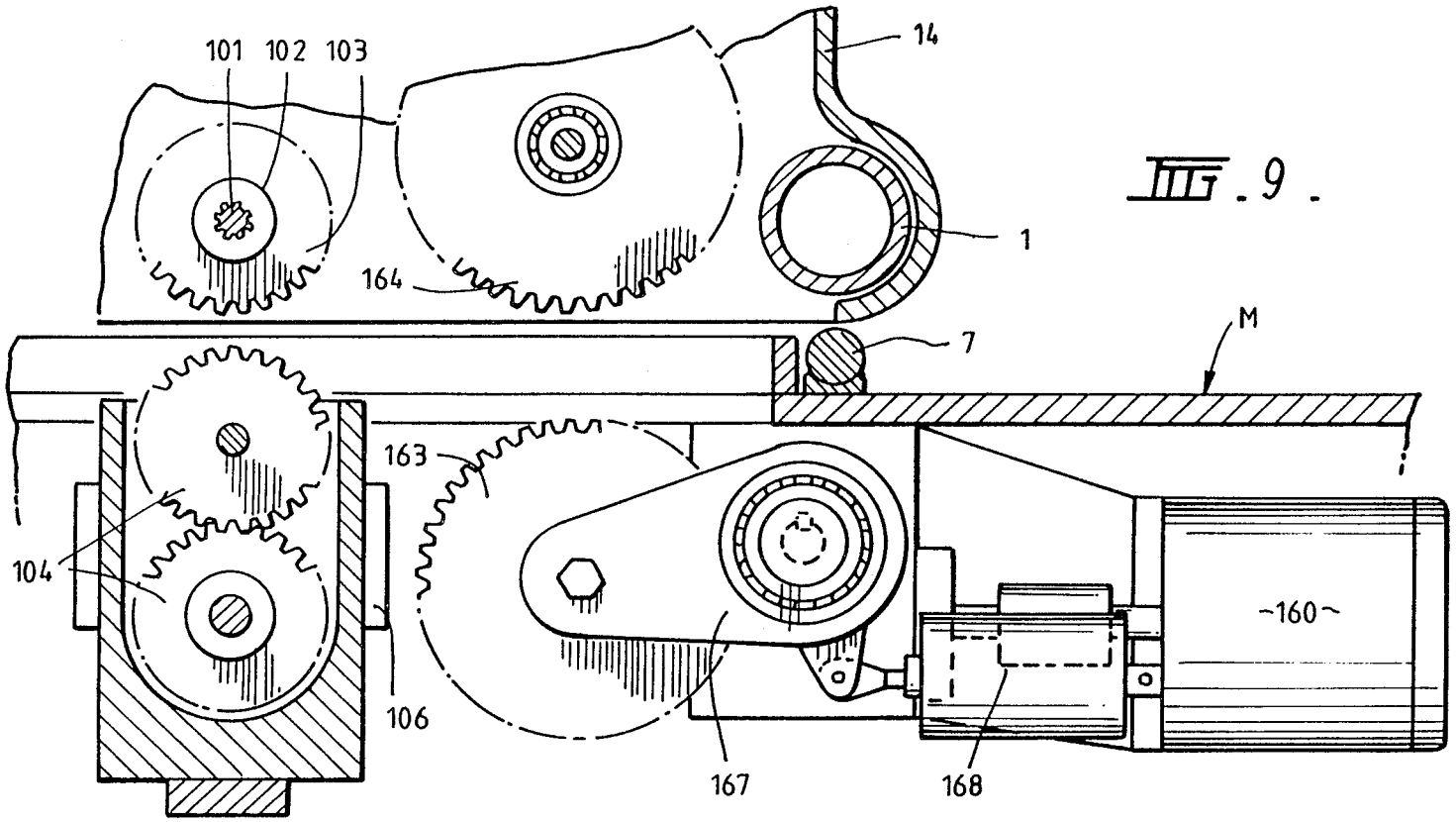
FIG. 9 is a fragmentary sectional end elevation of part of the drive mechanism showing the drive to the rollers disconnected.

When the trolley T is moved to one of the shearing positions S, the yokes 167,177 are in the position shown in FIG. 9 of the drawings, so that the gears 163,173 do not project above the top of the floor of the shearing module M. When the trolley T is in position, low pressure air is applied to the actuators 168,178 to raise the yokes 167,177 so that the gears 163,173 mesh with the idler gears 164,174 carried by the trolley T. A magnetic sensor (not shown) on each of the actuators 168,178 senses whether correct meshing of the gears has been achieved through the position of the actuator piston, and high pressure air is then applied to the actuator to keep the gears 163,173 and 164,174 firmly in mesh. If the sensor indicates that correct mesh has not been achieved, the stepper motors 160,170 are turned until proper meshing is achieved whereupon the yokes 167,177 are rotated to their fully engaged positions. It will be appreciated that each roller 16 and 17 may be independently driven under the control of the central computer so that the required manipulation of the sheep supported by the rollers may be achieved.

Figure 12:
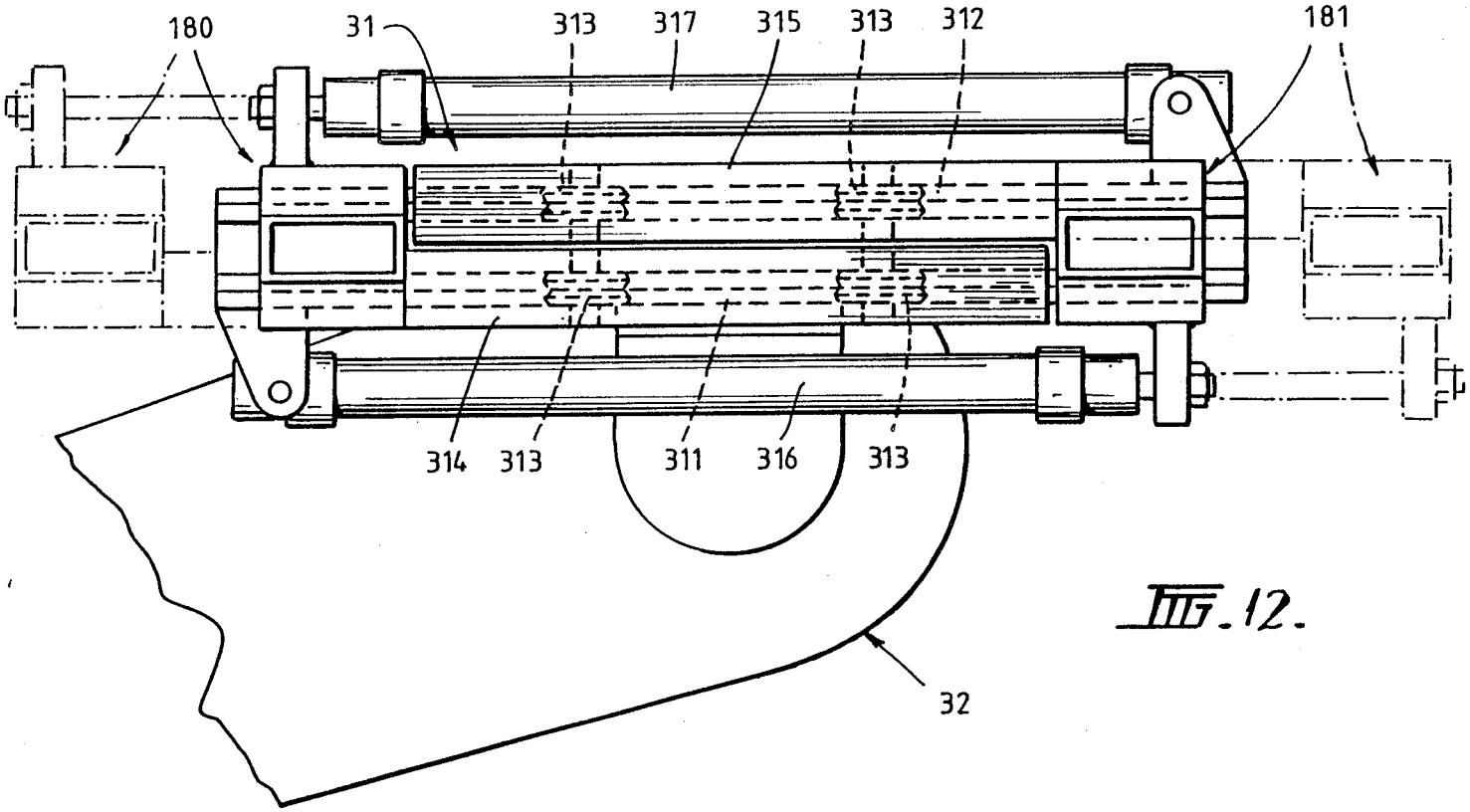
FIG. 12 is a front elevation of the rear leg spreading means taken along the line 12—12 in FIG. 11.
Figure 13:
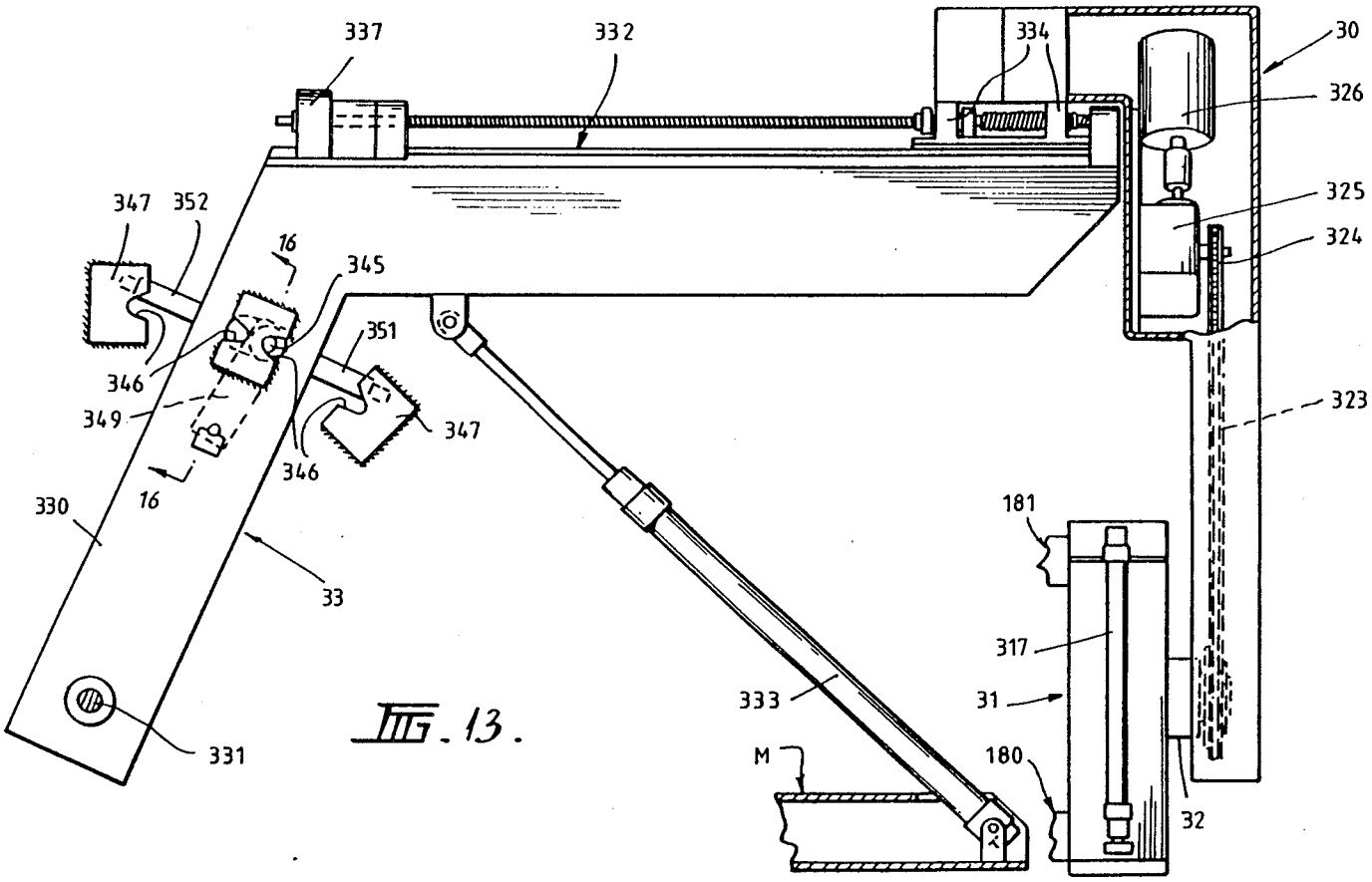
FIG. 13 is a sectional plan view showing the remainder of the rear leg manipulating mechanism.

The rear leg manipulation mechanism provided at each shearing station S is shown in greater detail in FIGS. 11 to 13 of the drawings. As described above, when the trolley T is at the loading station, the rear leg clamping bars 20 and 21 are carried by the rear support plate 19 via engagement between the lugs 23 and the similarly shaped socket 24. The bars 20,21 each have a shaped rear portion 200 which pivotally carries the front portion 201 via pivot 202, pivotal movement being restricted by a pin 203 engaging a slot 204 in the rear portion 200. When the lugs 23 are in their sockets 24 the rear portion 200 is in its downwardly pivoted position in which the support plate 19 is engaged by the rear portion 200 to hold it in its socket 24. This is shown most clearly in broken outline in FIG. 11 of the drawings.

When the trolley T is moved into one of the shearing positions S, the rear end of each rear leg clamp bar is received within a supporting socket 180,181 carrying a clamping key 182 (FIG. 11) formed with a slot 183 which receives the rear end of each rear leg clamp bar 20 and 21. The clamping key 182 is powered by compressed air to move within its cylinder to pivot the rear portion 200 upwardly to the position shown in FIG. 11 to release the support plate 19 and to cause the slamped end of the rear portion to engage a clamping plate 184 in the sockets 180,181 to firmly clamp the rear leg clamp bars 20 and 21 in their respective sockets 180 and 181. When clamping has thus been achieved, a keyed shaft 184 which carries the support plates 19 may be rotated through 90° to remove the lugs 23 from their sockets 24 and locate the plate 19 in its inactive position as shown in FIGS. 3 and 11 of the drawings. Rotation of the keyed shaft 184 is achieved by means of a rotary actuator located at the shearing position S, which is brought into engagement with the keyed shaft 184 under the control of the central computer. The rotary actuator is not shown and it may take any suitable form known to persons skilled in the art.

The sockets 180 are carried by a rear leg manipulating mechanism 30 (shown most clearly in FIGS. 2 and 3 of the drawings) and which includes a rear leg spreading mechanism 31, means 32 for rotating the spreading mechanism 31 about a longitudinal axis, and means 33 (FIGS. 2 and 13) for pivoting the assembly of the above components about a vertical axis, as will be described in greater detail below.

The rear leg spreading mechanism is shown most clearly in FIGS. 11 and 12 of the drawings, and comprises a support plate 310 carried by a boss 320 secured to the output shaft 321 of the rotating mechanism 32. The support plate 310 in turn carries two precision ground slide bars 311,312, each of which is engaged by spaced opposed pairs of grooved rollers 313 rotatably mounted in carriers 314,315, with the socket 180 attached to the carrier 314 and the socket 181 attached to the carrier 315. Actuators 316,317 are attached to the slide bars 311 and 312 and to the carriers 314 and 315 such that operation of the actuators 316 and 317 causes the sockets 180 and 181 to be spread apart in the manner shown in broken outline in FIG. 12 of the drawings.

The means 32 for rotating the spreading mechanism 31 includes a sprocket 322 attached to the boss 320 and engaged by a drive chain 323 which in turn engages a drive sprocket 324 attached to the output shaft of a gear box 325 driven by a motor 326 (FIGS. 4 and 13) to rotate the boss about the shaft 321.

The pivoting means 33 comprises a bend arm 330 mounted on a vertical pivot 331 provided at the rear end of each shearing position S of each module M. The position of this pivot 331 is adjustable to allow for different roller lengths whereby the pivot is always located at about the end of the rollers. The bend arm 33 is a cranked arm which carries the remainder of the rear leg manipulating mechanism 30 on a slide-way 332 formed on an outer face of the arm 330. The arm 330 is pivoted by an actuator 333 under the control of the central computer, to pivot the bend arm 330 through about 20° to either side of the central position shown in FIG. 2 of the drawings. The actuator 333 is also capable of pivoting the arm 330 through about 25° to one side of the central position for loading and unloading of trolleys T in the shearing position S.

The principal reason for pivoting of the bend arm 330 is to bend the rear legs of the sheep about a vertical axis to condition the skin in the region of the stifle joint to make shearing easier. The other reason is to remove the rear leg manipulating mechanism from the path of the trolley T during loading and unloading.

Figures 14, 15:
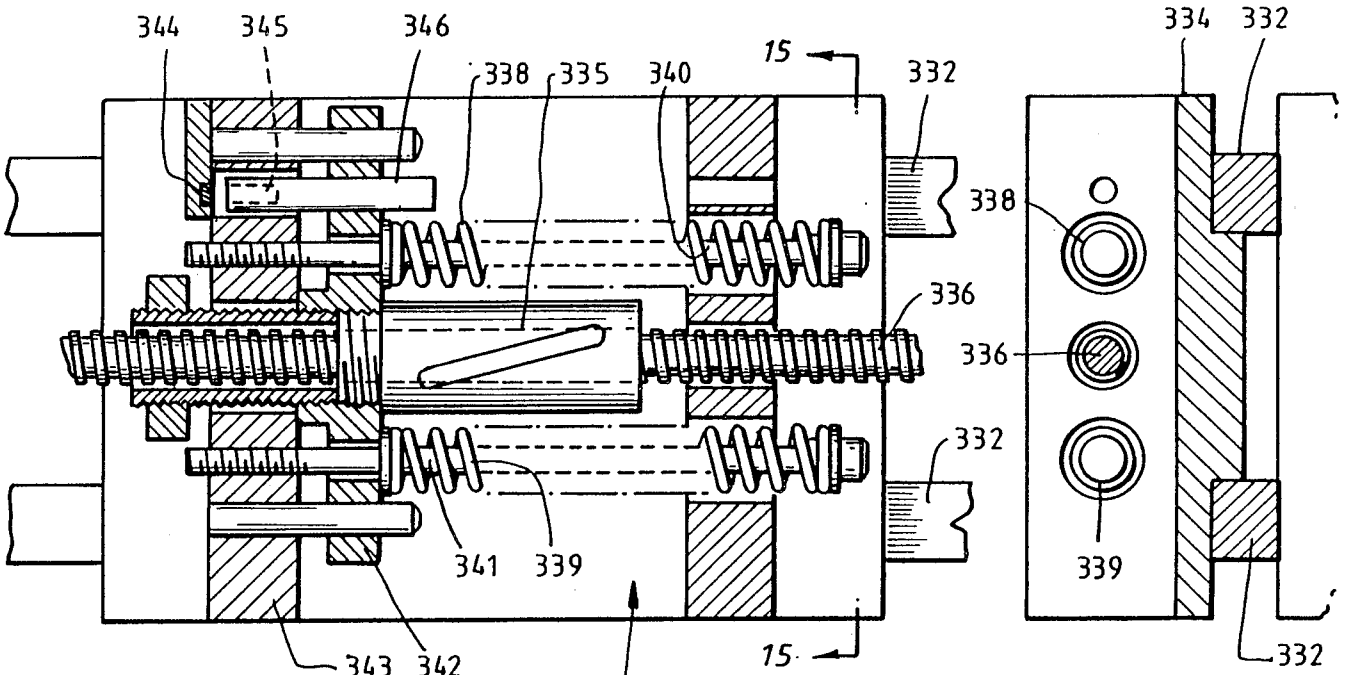
FIG. 14 is a fragmentary sectional plan view of part of the rear leg extending mechanism carried by the manipulating mechanism of FIG. 13.
FIG. 15 is a sectional and elevation of the extending mechanism of FIG. 14 taken along the lines 15—15 in FIG. 14.

The assembly which carries the spreading means 31 and the rotating means 32 is mounted on the sliding carriage 334 which engages the slide-way 332, and which is shown in greater detail in FIGS. 14 and 15 of the drawings. The carriage 334 carries a ball nut 335 engaged by a lead screw 336 driven by a stepper motor 337 (FIG. 13) supported by the bend arm 330. Actuation of the stepper motore under the control of the central computer causes the position of the rear leg clamps to be adjusted, depending on the length of the sheep, and to apply a slight stretching force to the rear legs when secured to the rear leg clamp bars 20 and 21. The force applied to the rear legs via the ball nut 335 is sensed by a pair of compression springs 338,339 supported by guide pins 340,341 and engaged by a plate 342 secured to the ball nut 335. The springs 338,339 are rated so that compression occurs only if a maximum safe load is exceeded when the rear legs of the sheep are stretched. In the event that the springs 338,339 do compress, movement of the plate 342 with respect to its support plate 343 is sent by a Hall effect sensor 344, which senses the weakening magnetic field of a magnet 345 carried by a support 346 secured to the plate 342.

Figure 18:
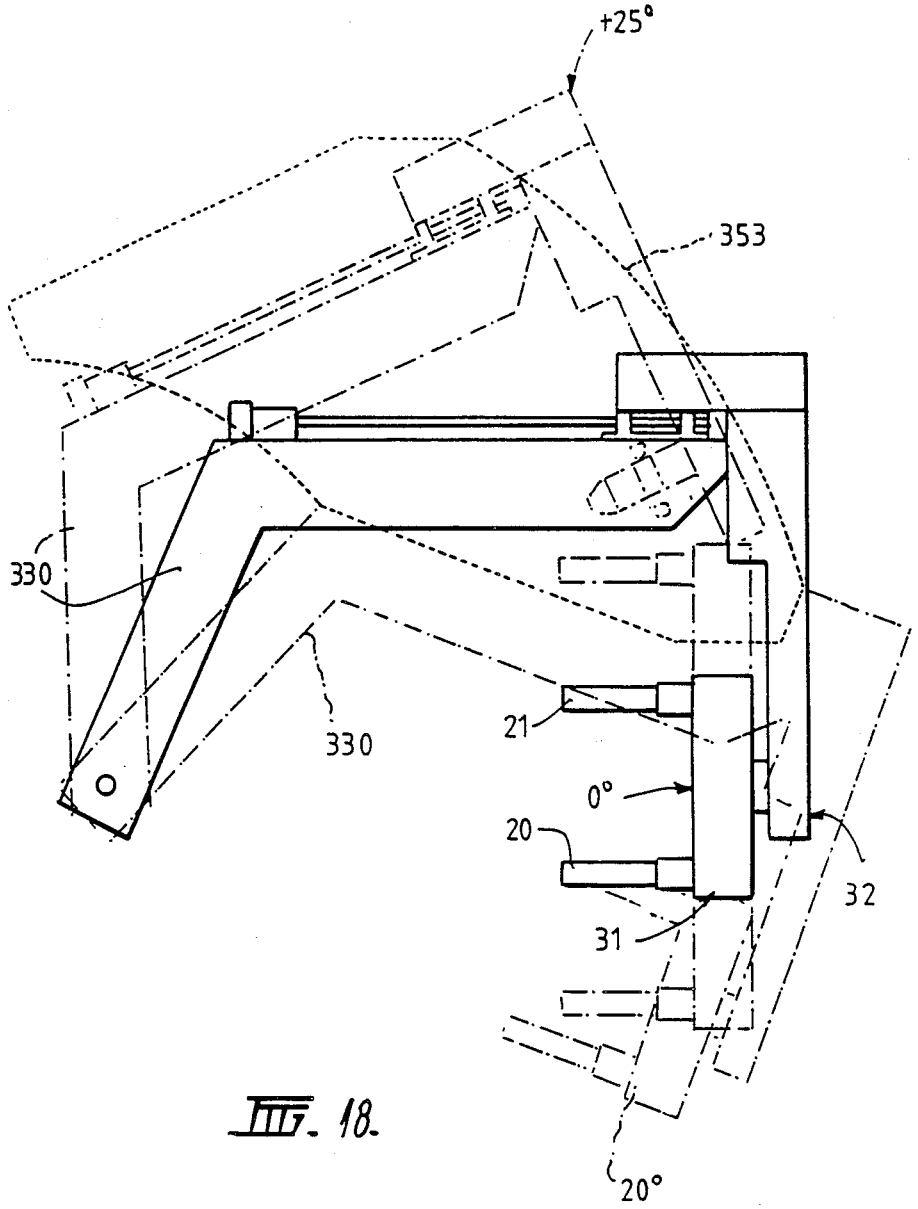
FIG. 18 is a plan view similar to FIG. 13 showing the kinematics of the rear end of the manipulating mechanism.
Figure 19:
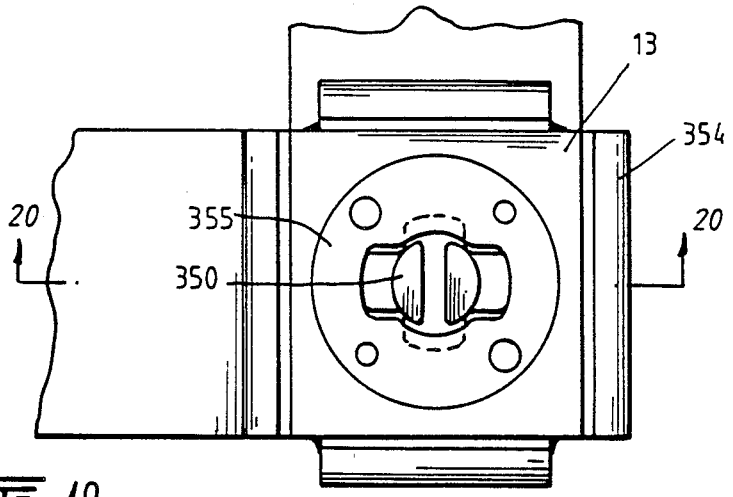
FIG. 19 is a fragmentary plan view of the front end docking mechanism.
Figure 21:
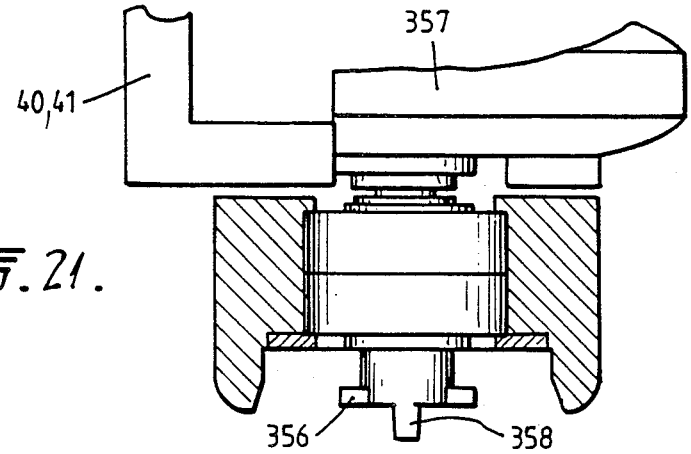
FIGS. 20 and 21 are fragmentary sectional elevations showing the components of the docking mechanism.
Figure 20:
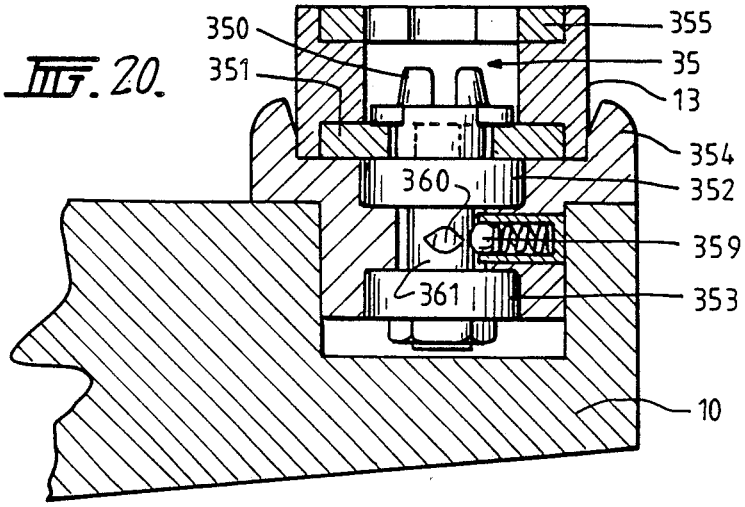

The position of the bend arm with respect to the module M is positively located in each of its four chosen positions, that is, −20°, 0° (in two alternative modes, depending on the direction of approach), and +20°, is achieved by means of a stop pin 345 carried by the bend arm 330 and engageable with shaped openings 346 in stop plates 347 (see also FIG. 13) secured to the floor of the shearing module M. The stop pin 345 is carried by a piston 348 mounted in a cylinder 349 which is pivotally mounted to the bend arm 330 via pivot pin 350. Pivotal motion of the cylinder 349 is constrained and restricted by adjustable shock absorbers 351 and 352 secured to the sides of the bend arm 330 at the extremes of movement of the cylinder 349. The position of the stop pin 345 will depend on the direction in which the central stop plate 347 is approached, and the pin 345 will engage either one of the shaped openings 346 in the central plate 347 depending on that direction. In either case, the bend arm 330 will come to rest at the same angular position (0°) due to the pivoting movement of the cylinder 349. No stop plate 347 is provided for locating the bend arm 330 in the +25° position. The kinetics of the bend arm 330 may be more fully appreciated from consideration of FIG. 18 which shows the bend arm in the central position and its −20° and +25° positions in broken outline. In FIG. 18, 353 designates the cut out which must be provided in the floor of the shearing module M to enable the required movement of the bend arm 330.

It should be appreciated that FIGS. 2 and 3 of the drawings show the rear leg clamp bars 20 and 21 attached to the rear leg manipulating mechanism forming part of the robotic shearing station S. When the sheep is initially loaded onto the trolley, its rear legs are clamped to the rear leg clamp bars 20 and 21 which are supported the support plate 19 until the rear leg manipulating mechanism is engaged with the rear leg clamp bars 20 and 21 in the manner shown in FIGS. 2 and 3 of the drawings. As will be seen from FIG. 3 of the drawings, the support plate 19 is formed with wedge shaped lugs 23 which engage similarly shaped sockets 24 forming part of the clamp bars 20 and 21.

Referring now to FIGS. 2, 5 and 19 to 21, it will be noted that the foreleg clamp bars 11 and 12 and the head clamp bar 13 are attached to the front end support 10 by means of rotating key locks 35. For simplicity, only one key lock 35 has been shown in FIGS. 5 and 19 to 21, attaching the head clamp bar 13 to the support 10. Each key lock 35 enables the foreleg clamp bars 11 and 12 and the head clamp bar 13 to be transferred from the support 10 to one of a pair of swing arms 40 and 41 which are provided within each module M at either side of the shearing position adjacent the front end of the trolley T (see FIG. 2).

Each key lock 35 comprises a central rotatable key 350 which is engaged with an inner female key plate 351 carried by the bar 11, 12 or 13, the key 350 being supported by bearings 352,353 mounted in a support member 354 engaging the support 10. The bars 11, 12 or 13 also carry an outer female key plate 355 with which a male key lock 356 carried by the swing arms 40,41 and actuated by a rotary actuator 357 may be engaged. It will be appreciated that the key lock 356 includes a secondary key 358 which engages the key lock 350 to cause disengagement of the key lock 350 from the inner plate 351 when the key lock 356 is engaged with the outer plate 355.

To ensure that the key lock 350 is positively held in its alternative positions, a spring loaded ball 359 is positioned within the mount 354 to engage milled depressions 360 is the shaft 361 of the key lock 350. Since the key lock 356 is positively rotated by a rotary actuator 357, a similar arrangement is not required on each of the swing arms 40 and 41.

Figure 27:
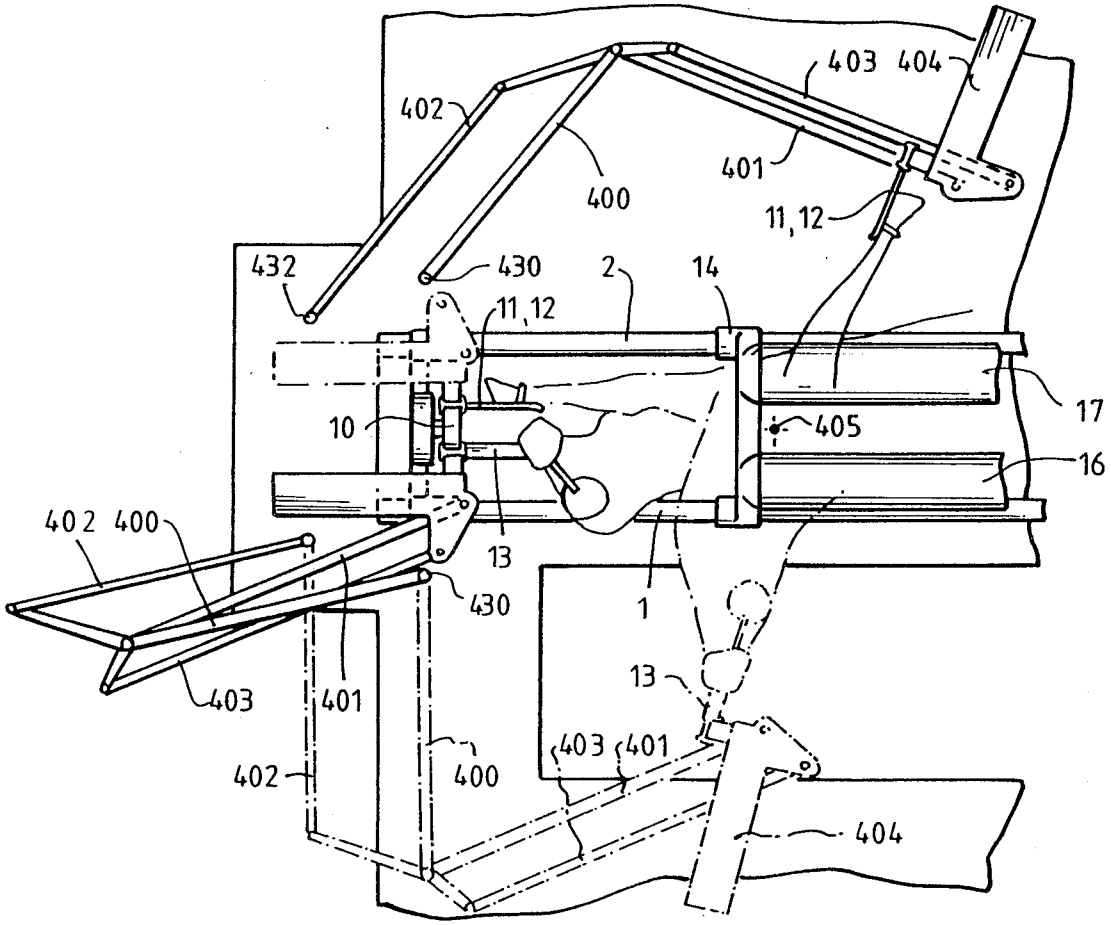
FIG. 27 is a schematic plan view of the front end of the shearing station showing the kinematics of the swing arm assemblies.

Each swing arm 40,41 comprises a principal arm 400, to the end of which a secondary arm 401 is pivotally attached. Links 402 and 403 define two inter-connected pantograph mechanisms such that a stretching mechanism 404 mounted at the ends of the arms 401 and links 403 may turn about the virtual centre point 405 (FIG. 2) located in the brisket region of the sheep supported by the rollers 16 and 17. The swing arm mechanism 40 and 41 are capable of being moved from a fully retracted position in which the stretching mechanisms 404 have an axis of operation parallel to the longitudinal axis of the trolley T (see lower half of FIG. 27), to the position shown in the upper half of FIGS. 2 and 27, to perform the required manipulation movements of the forelegs and head of the sheep.

Figure 22:
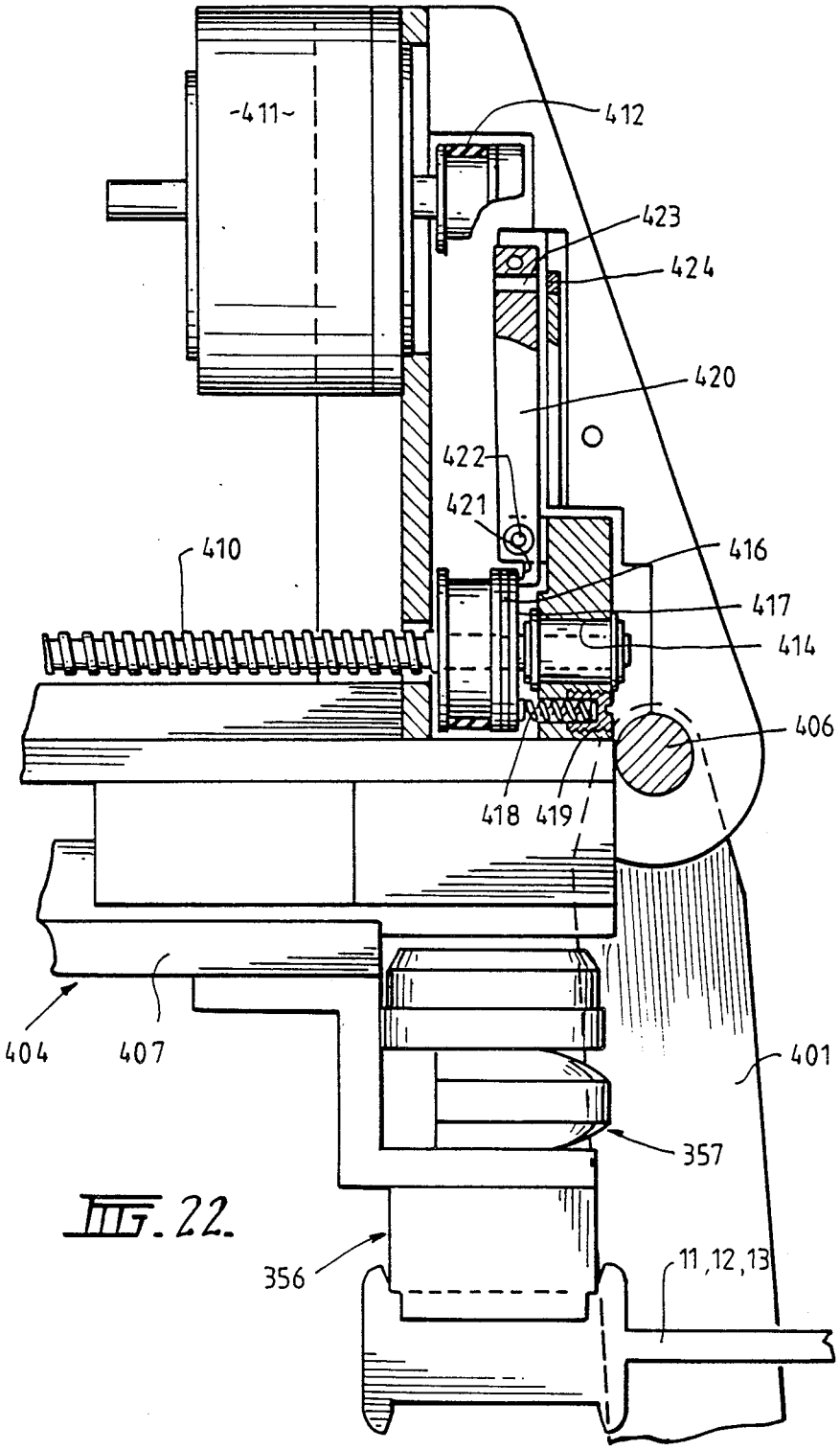
FIGS. 22 and 23 are elevations of the mechanism for extending the front leg swing arms.
Figure 23:
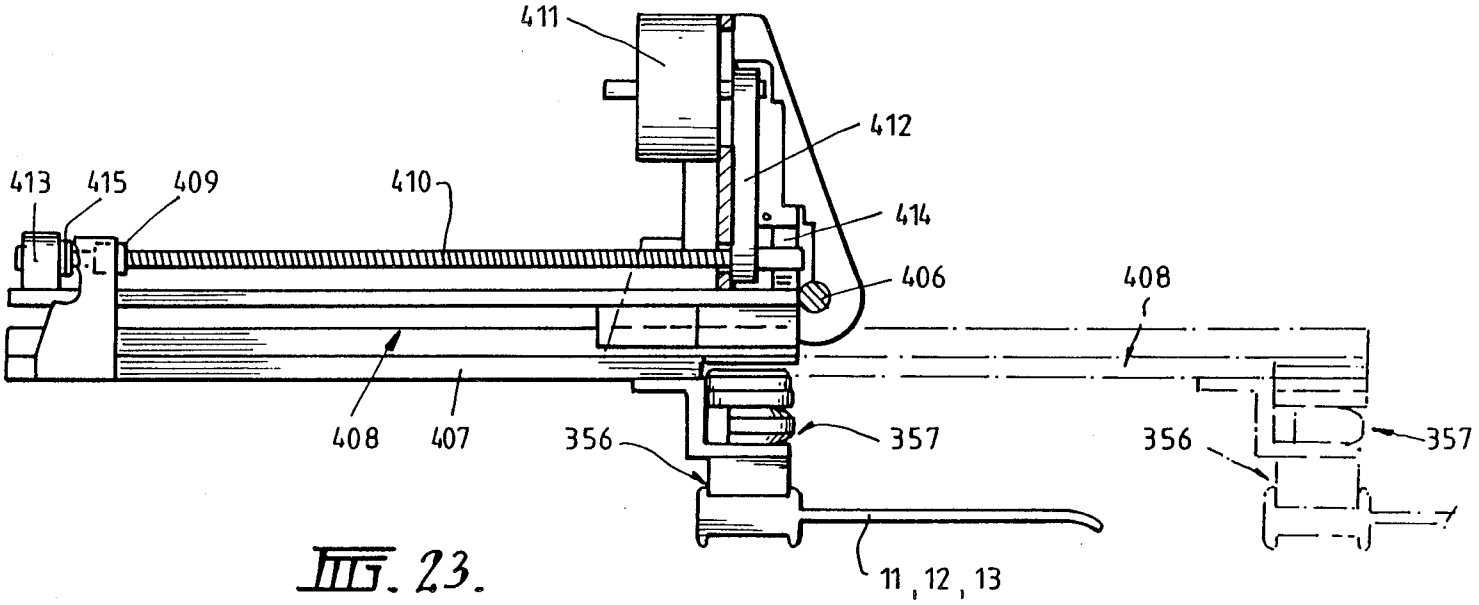
Figure 24:
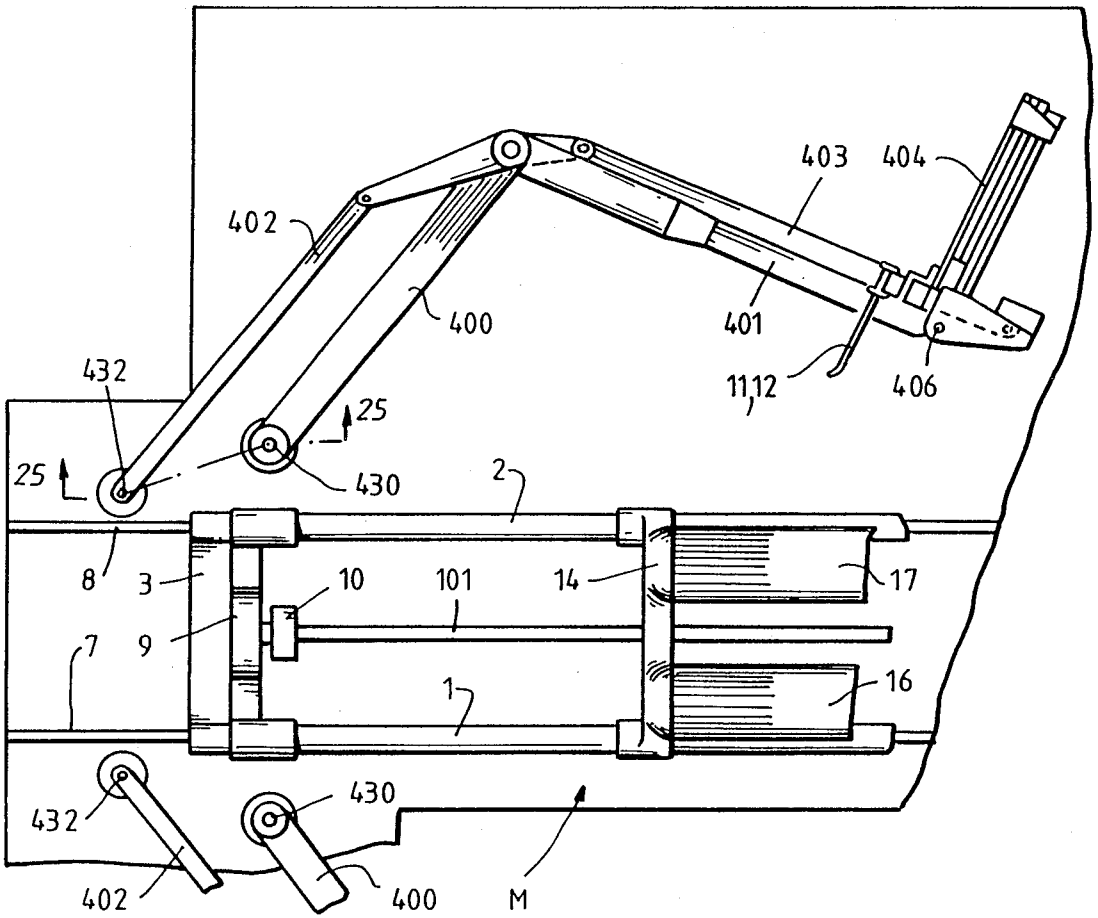
FIG. 24 is a fragmentary plan view of the front of the shearing station showing one of the swing arm assemblies in greater detail.

The extending mechanisms 404 are pivotally attached to the arms 401 through pivot pins 406 (FIGS. 22, 23, 24 and 27) and each mechanism 404 comprises a slide member 407, which carries the key lock mechanism 356 and actuator 357, and engages a slide-way 408 for longitudinal movement along the slide-way 408 by means of a ball nut 409 engaging a ball screw 410 driven by a stepper motor 411 via a timing belt drive 412. The ball screw 410 is supported in linear/rotary bearings 413,414 in a manner which allows the ball screw to float longitudinally by about 0.5 mm against thrust bearings 415 and 416 (FIG. 22).

Stretching forces applied to the forelegs or head of the sheep by means of the sliding member 407 causes the ball screw 410 to apply a longitudinal force against the thrust bearing 416, and this force is transmitted to a hardened disk 417, held against rotation by pins (not shown). The thrust is taken by compression springs 418 carried by the support for the rotary bearing 414, and having their compressive force adjusted by a nut 419 threadably engaged with the bearing support. Movement of the ball screw 410 is detected by a lever 420 having a nose portion 421 in contact with the thrust disk 417. The lever 420 is pivoted adjacent the nose portion 21 about a fulcrum 422 so that small movements of the nose portion 421 create large movements of the opposite end of the lever 420. A magnet 423 is mounted in the lever 420 adjacent its free end and Hall effect switch 424 is positioned adjacent the magnet 423. Movement of the magnet 423 away from the Hall effect switch 424 deactivates the switch so that the central control computer is able to determine when the exterior force applied by the carriage 407 exceeds a predetermined limit determined by the position of the nut 419. Compliance of the springs 418 is limited by stop sleeves (not shown) such that the compliance will not affect docking engagement at the time of docking transfers between the swing arms 40 and the bars 11, 12 and 13.

Figure 25:
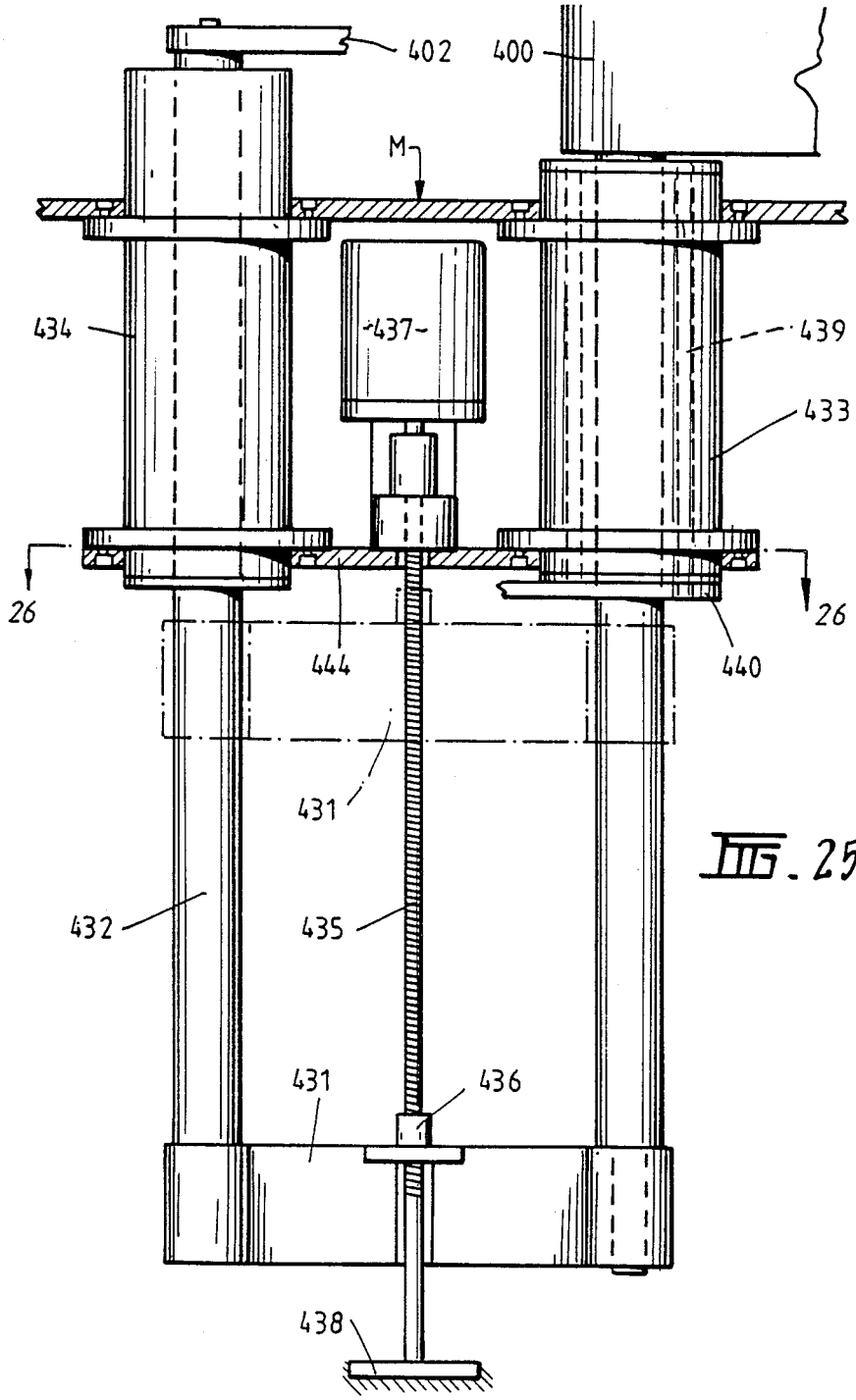
FIG. 25 is an elevation of a raising and lowering mechanism for the swing arm assemblies.
Figure 26:
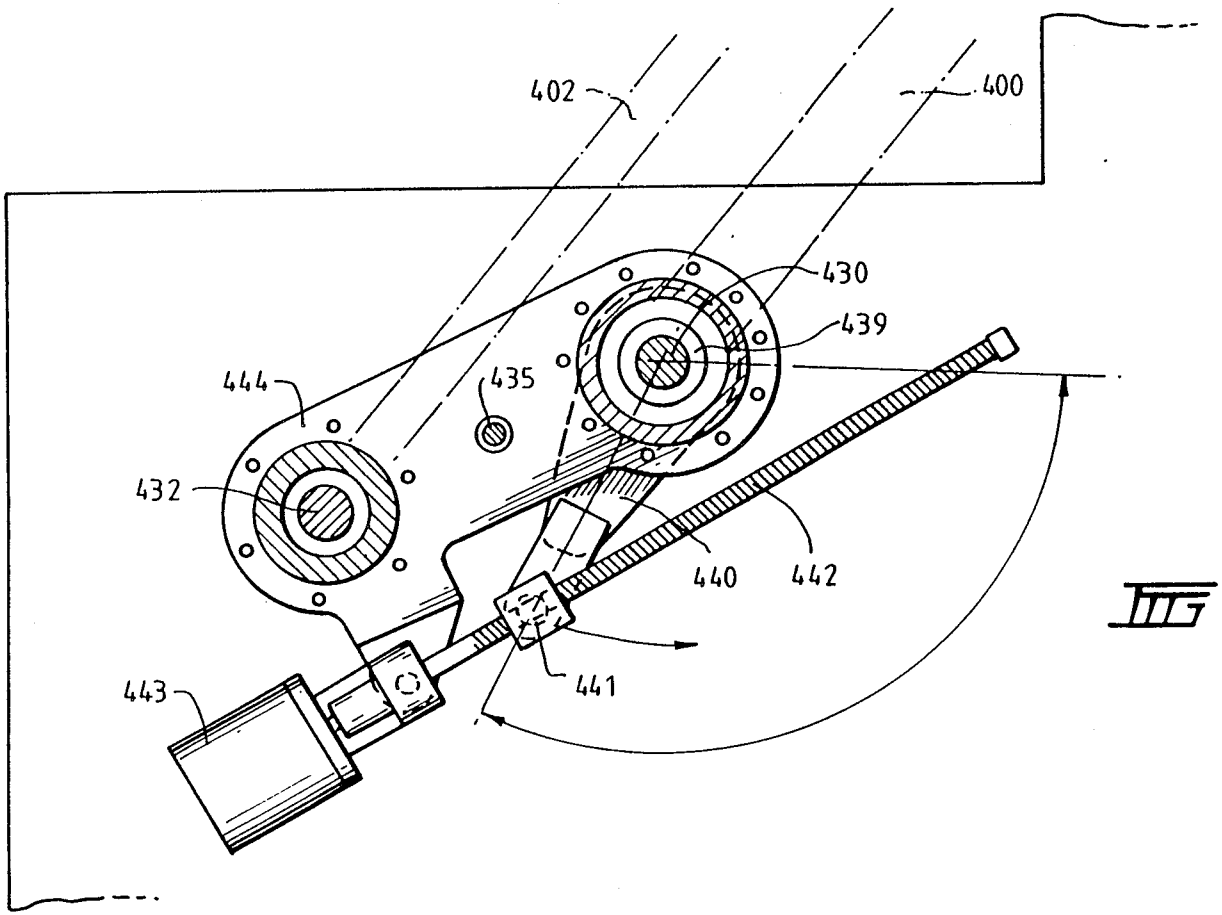
FIG. 26 is a fragmentary sectional plan view showing the means for rotating the swing arms.

As shown most clearly in FIGS. 25 and 26, the principal and secondary arms 400 and 402 of the swing arms 40 are capable of being vertically elevated by the mechanism shown in FIG. 25 and are rotated by the mechanism shown in FIG. 26. The principal arm 400 is carried by a splined shaft 430 connected at its lower end by a bridge member 431 to a linear shaft 432, to which the secondary arm 402 is attached. The shafts 430 and 432 are supported by a linear spline bearing 433 and a linear bearing 434 which are rigidly supported under the floor of the shearing module M. Vertical movement of the shafts 430 and 432 is achieved by a ball screw 435 engaging a ball nut 436 and rotated by a stepper motor 437. The free end of the ball screw is mounted in bearing plate 438 suitable anchored under the floor of the module M. A pneumatic counterbalancing mechanism (not shown) provides a constant upward force to the bridge member 431 to balance the weight of the swing arm assemblies 40.

Figure 28:
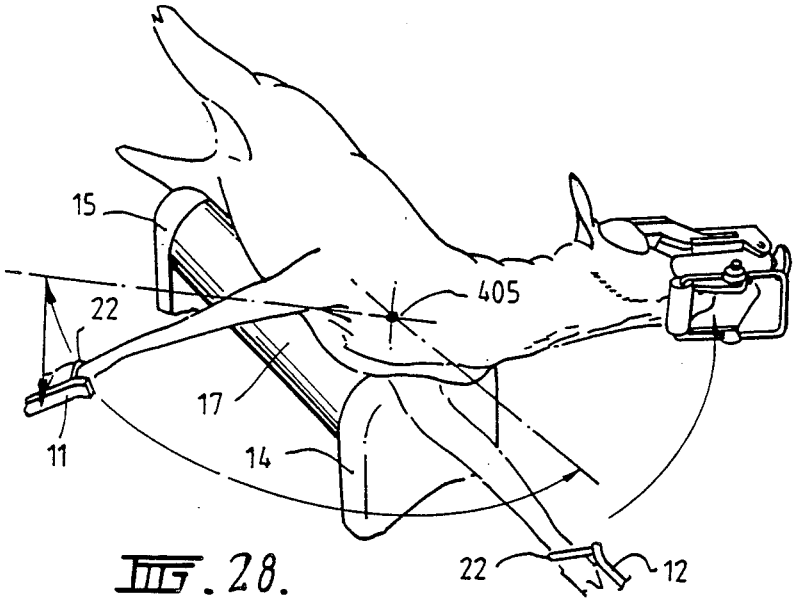
FIGS. 28 and 29 are schematic diagrams showing two of the manipulation positions of a sheep supported on the trolley.
Figure 29:
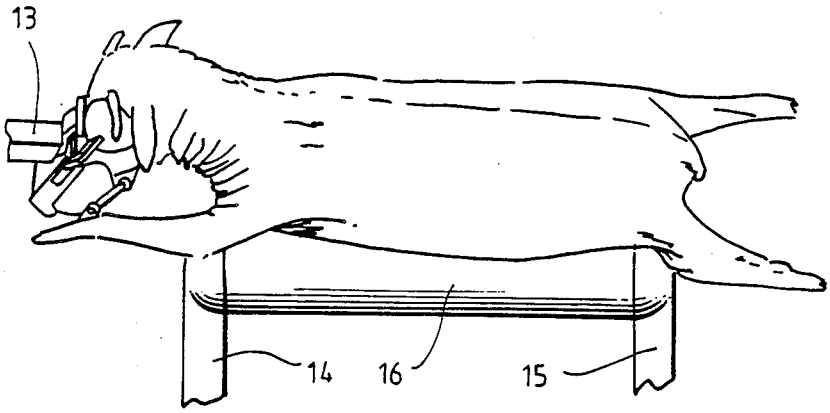

The splined shaft 430 is mounted in and keyed to a bearing sleeve 439 to which a quadrant lever 440 (see also FIG. 26) is rigidly attached. A ball nut 441 is pivotally attached to the quadrant arm 440 and is engaged by a ball screw 442 driven by means of a stepper motor 443 carried by a support plate 444 attached to the housings of the support bearings 433 and 434. The stepper motor 443 is capable of rotating the linear splined shaft 430 through an angle of about 115° to achieve the required rotation of the swing arms 40. Two of the shearing operations capable of being achieved by the manipulator embodying the invention are shown in FIGS. 28 and 29 of the drawings. In the position shown in FIG. 28, the sheep is manipulated to facilitate shearing of the front leg and neck of the sheep. In this position, the upper front leg is rotated about the brisket through an angle of about 120° and then lowered to the position shown. The head and neck are rotated through an angle of about 60° in the position shown. The head and neck are returned to the central position to facilitate shearing of the upper half of the neck and the sides of the sheep. In this position, the foreleg extending forwardly of the trolley T is attached to the front end post to restrain the sheep longitudinally.

In the position in FIG. 29, the body of the sheep has been rotated through 180° from its starting position to present the back of the sheep for shearing. The head restraint shown in these figures is the currently preferred head restraint which is described in greater detail in our co-pending Application No. AU-A20664/88, the contents of which are incorporated herein by cross reference.

The preferred embodiment described above provides a relatively simple solution to the complex problems associated with achieving automated shearing of a sheep. The use of separate trolleys T for initially restraining the sheep on its back, and which cooperates the manipulation drive means at each shearing station S, simplifies the loading and unloading operation and allows a human operator to assess the type and size of the sheep and to assess the condition of the fleece, all of which information may be fed into the central controlling computer to suitable adjust the shearing strategy. The human operator may also shear parts of the head and crutch by hand if the sheep is a particularly difficult one to shear in those areas. At the unloading station, the operator may, in addition to releasing the sheep, apply desired treatments to the sheep and remove any pieces of wool left unshorn by the shearing system.

The use of the standardized trolley T in conjunction with the drive and manipulating mechanisms at each shearing station reduces the complexity of the trolley whereby it may be easily unloaded and loaded and transported to and from the shearing stations S. Nevertheless, each trolley includes the drive mechanisms necessary to perform certain manipulation operations on the sheep, including independent drive to each of the rollers 16 and 17 so that they may be used either to rotate the sheep, when they are rotated in the same direction, or to stretch or bunch the skin of the sheep, when they are rotated in opposite directions. This manner of driving the rollers, in combination with the manipulation capabilities provided by the swing arms 40 and the rear leg manipulating mechanisms 31, 32 and 33, enable the fleece of the sheep to be appropriately presented and the skin of the sheep to be conditioned in a number of different ways to maximise the efficiency of the automated shearing operation.

The drive mechanism in each trolley are purely mechanical and are unpowered for simplicity and durability of each trolley. Similarly all sensors required for the automated shearing process are provided at each shearing station S rather than on the trolleys T.

The connection of the parts of the trolley to the manipulating mechanism provided at each shearing station S is able to be achieved automatically so that human operators are only required to load and unload the sheep and to generally monitor the automated shearing operation. When each trolley T is positioned at a shearing station, the trolley T is locked in position on its tracks 7 and 8 by means not shown in the drawings, whereupon the trolley is automatically connected to the manipulator in the manner described in greater detail above. Shearing of the sheep is then performed by the shearing robot $S_M$ under the control of the central computer. When the shearing operation is completed, the drive gears are retracted and the leg and head restraints are returned to the trolley fittings whereupon the trolley is removed from the shearing station S.

The contents of Provisional Specifications PI 4317 and PI 9319 are incorporated herein by cross reference.

I claim:

1. A system for handling animals such as sheep and goats in the automated treatment of such animals, comprising a multiplicity of animal supporting devices carrying means for supporting the animal and for restraining the front legs, rear legs and head of the animal, each said supporting device being capable of being transported from an animal loading station to a treatment or manipulation station, means at said manipulation station for engaging and manipulating said supporting and restraining means to facilitate treatment of the animal, whereupon the supporting device may be transported with the animal restrained thereon to an unloading station.

2. The system of claim 1, wherein each animal supporting device preferably comprises a pair of spaced generally parallel rollers, frame means having means for supporting said rollers for rotation about their longitudinal axes, said frame means including means by which the supporting device may be transported from said loading station to said treatment or manipulation station, said means for restraining the front legs, rear legs and head of the animal being carried by said frame means in a selectively releasable manner whereby said restraining means may be transferred to the manipulating means at said treatment or manipulation station.

3. The system of claim 2, wherein the frame supporting said rollers carries wheels whereby the supporting device defines a trolley, said wheels being formed to engage rails at the treatment or manipulation station whereby the trolley may be accurately positioned at said station.

4. The system of claim 2, wherein each supporting device including a front support assembly and a rear support assembly adjusting carried by said frame means to allow animals of different sizes to be restrained on the device, said front support assembly including said means for restraining the front legs and head of the animal, said rear support assembly including said means for restraining the rear legs of the animal, and drive means associated with said rollers and engagable by drive means provided at said treatment or manipulation station to rotate the rollers during the treatment operation.

5. The system of claim 1, wherein the manipulating means at the treatment or manipulation station including a pair of swing arms positioned in use adjacent the head of the animal and having means for selectively engaging each of the means for restraining the front legs and head of the animal whereby the front legs and head of the animal may be independently manipulated during the shearing process, said manipulating means further including rear and manipulating means for engaging each of the rear leg restraining means and for spreading the legs, rotating the legs and for pivoting the rear end portion of the sheep about a generally vertical axis.

6. The system of claim 4, wherein said front support assembly carries said front leg and head restraining means on a rotatable support, and drive means for rotating said support, said support drive means being selectively engageable by said drive means at said treatment or manipulation station to cause rotation of said support during the treatment process.

7. The system of claim 5, wherein said rear end manipulating means includes an arm pivoted about a generally vertical axis adapted to substantially coincide with the ends of the rollers, said arm carrying said engaging means on a sliding carriage which permits longitudinal adjustment of the position of the carriage whereby the legs of the sheep may be stretched, and means for locking said pivoted arm in each desired manipulation position.

8. An animal supporting and transporting cradle comprising a pair of spaced generally parallel rollers, frame means having means for supporting said rollers for rotation about their longitudinal axes, said frame means having means by which said cradle may be transported from a loading station to a treatment or manipulation station, said frame also carrying means for restraining the front legs, rear legs and head of the animal, said front leg and head restraining means being carried by a front support in a selectively releasable manner to enable said front leg and said head restraints to be engaged by manipulating means by which said front legs and head are independently manipulated, said rear leg restraining means being carried by a rear support in a selectively releasable manner whereby said rear leg restraining means may be engaged by a rear leg manipulating means.

9. The cradle of claim 8, wherein said front leg and head restraining means are releasably secured to a support which is rotatably mounted on said front support means, said front support means carrying drive means for rotating said support, and drive means associated with said rollers, both of said drive means being selectively engagable by powered drive means at said treatment or manipulation station.

10. The cradle of claim 8, wherein said roller drive means includes independent drive means for each roller to enable the rollers to be driven in the same or opposite directions.

* * * * *